United States Patent [19]

Hiroyuki

[11] Patent Number: 4,829,295

[45] Date of Patent: May 9, 1989

[54] IMAGE SYNTHESIZER

[75] Inventor: Murata Hiroyuki, Tokyo, Japan

[73] Assignee: Namco Ltd., Tokyo, Japan

[21] Appl. No.: 30,706

[22] Filed: Mar. 25, 1987

[30] Foreign Application Priority Data

Mar. 31, 1986 [JP] Japan ..... 61-73163

[51] Int. Cl.[4] ..... G09G 1/06

[52] U.S. Cl. ..... 340/728; 340/747

[58] Field of Search ..... 340/723, 724, 727, 728, 340/729, 747; 364/200, 518, 519, 520, 521, 522; 358/104; 434/43, 44

[56] References Cited

U.S. PATENT DOCUMENTS

| | | | |
|---|---|---|---|
| 4,318,175 | 3/1982 | Hawley | 364/200 |
| 4,371,872 | 2/1983 | Rossman | 340/728 |
| 4,489,389 | 12/1984 | Beckwith et al. | 340/728 |
| 4,609,917 | 9/1986 | Shen | 340/747 |
| 4,614,941 | 9/1986 | Jarvis | 340/723 |
| 4,648,045 | 3/1987 | Demetrescu | 364/521 |
| 4,658,247 | 4/1987 | Gharachorloo | 340/747 |
| 4,677,574 | 6/1987 | Kausch | 340/747 |
| 4,697,178 | 9/1987 | Heckel | 340/747 |
| 4,700,181 | 10/1987 | Maine et al. | 340/724 |

*Primary Examiner*—Gerald L. Brigance
*Assistant Examiner*—Richard Hjerpe
*Attorney, Agent, or Firm*—Koda and Androlia

[57] ABSTRACT

An image synthesizer to which outline point information of an image is supplied from an image information supply source. This apparatus comprises an outline point information storing means for successively writing and storing outline point information which consists of the positions of pairs of right and left outline points at which the outline of a figure for CRT display intersects respective horizontal scanning lines and additional data on this figure in the order of priority in respective horizontal scanning memory areas which are provided in correspondence with the respective horizontal scanning lines, a line processor circuit for successively reading the outline point information in synchronization with a horizontal scanning signal from the horizontal scanning memory area which corresponds to a vertical scanning position, and a line buffer having memory areas of a number which at least corresponds to the number of pixels for one horizontal scanning, the additional data contained in the outline information which has been read from the horizontal scanning memory area being successively written in the memory areas which are defined by the corresponding pair of outline points. Whenever a horizontal scanning signal is output, an image signal for horizontal scanning is synthesized and output through the line buffer.

13 Claims, 22 Drawing Sheets

(A)

(B)

FORMAT OF LINE BUFFER

FIG. 5 (B)

FORMAT OF VACANT AREA DETECTION UNIT

| ADDRESS (X COORDINATE) | 0 | 1 | 2 | | $X_{LB}$ | $X_{LB}$ +1 | | $X_{LC}$ | $X_{LC}$ +1 | | $X_{RC}$ -1 | $X_{RC}$ |
|---|---|---|---|---|---|---|---|---|---|---|---|---|
| DATA (VACANT PIXEL) | 0 | 0 | 0 | | 1 | 1 | | 1 | 1 | | 1 | 1 |

$\ulcorner 0 \lrcorner$ $\ulcorner 1 \lrcorner$

| $X_{LA}$ | $X_{LA}$ +1 | | $X_{RB}$ -1 | $X_{RB}$ | | $X_{RA}$ -1 | $X_{RA}$ | | 574 | 575 |
|---|---|---|---|---|---|---|---|---|---|---|
| 1 | 1 | | 1 | 1 | | 1 | 0 | | 0 | 0 |

$\ulcorner 0 \lrcorner$

FORMAT OF LINE BUFFER

FIG. 6 (B)

FORMAT OF VACANT AREA DETECTION UNIT

| ADDRESS (X COORDINATE) | 0 | 1 | 2 | | $X_{LB}$ | $X_{LB}$ +1 | | $X_{LC}$ | $X_{LC}$ +1 | | $X_{RC}$ -1 | $X_{RC}$ |
|---|---|---|---|---|---|---|---|---|---|---|---|---|
| DATA (VACANT PIXEL) | 0 | 0 | 0 | | 0 | 0 | | 0 | 0 | | 0 | 0 |

"0"

| | $X_{LA}$ | $X_{LA}$ +1 | | $X_{RB}$ -1 | $X_{RB}$ | | $X_{RA}$ -1 | $X_{RA}$ | | 574 | 575 |
|---|---|---|---|---|---|---|---|---|---|---|---|
| | 1 | 1 | | 1 | 1 | | 1 | 0 | | 0 | 0 |

"1" "0"

| FIG. 12A |
| --- |
| FIG. 12B |

| FIG. 16A | FIG. 16B |
|---|---|

| FIG. 18A | FIG. 18B |
|---|---|

| FIG.20A | FIG.20B |
|---|---|

IMAGE SYNTHESIZER

BACKGROUND OF THE INVENTION

1. Field of the Invention

The present invention relates to an image synthesizer and, more particularly, to an image synthesizer which is capable of synthesizing and outputting an image signal at a real time on the basis of image information which is outputted from an image information supply source.

2. Description of the Prior Art

An image synthesizer synthesizes and outputs various image signals for CRT display on the basis of image information supplied from the outside. Since it is able to synthesize and output not only a two-dimensional plane image signal but also a signal for the two-dimensional image of a solid body, namely, a pseudo-three-dimensional image signal, it has been finding wide applications in, for example, three-dimensional video games, simulators for airplanes and various other vehicles, computer graphics and displays of CAD apparatus.

Such an image synthesizer conventionally adopts what is called a bit-map-display (graphic display) technique, and is therefore provided with a bit-map-memory which has memory areas having one-to-one correspondence with respect to all the pixels on the display of the CRT.

Into each of the memory areas are written all pieces of pixel information to be displayed in one frame. For example, when a given figure is displayed in computer graphics or the like, the outline of the figure is written on the CRT and the inside of the figure is colored out by a designated color which has been written in the memory.

In such an image synthesizer it is often the case that a plurality of figures are to be displayed simultaneously. Particularly, when a plurality of figures are displayed with overlapping portions, there is a problem regarding how the overlapping portions are to be colored.

A device which colors figures in the order of priority and a device which colors figures in the reverse order of priority are conventionally known as devices for dealing with such a problem.

Both of these conventional devices, however, have the following problems (A) to (C), and effective means for solving these problems have been in demand.

(A) The former type of device suffers from the problem that it is difficult to obtain a real-time display of a rapidly moving image, because it is very difficult for it to process an image quickly.

When a plurality of figures are successively colored in the order of priority, namely, from a figure having a high priority (situated in the foreground) to a figure having a low priority (situated in the distance), and they are displayed with overlapping portions, it is necessary to prevent the data on the figure having a higher priority, which is written first, from being deleted by the data on the figure which is to be colored later.

Therefore, in such a conventional device, all data on the figures to be colored out are read from the respective data write areas prior to the coloring out process, and judgement is made as to whether or not the data are written in each area. The coloring out process is only executed in the areas which have been judged to have no written data. This operation is called a read-modify-write operation.

Consequently, high-speed coloring out processing with respect to the bit-map-memory is impossible in the conventional device, and the coloring out operation of the bit-map-memory is often unable to catch up with a change in images. In particular, it is impossible to display a rapidly moving image at the real time.

It is possible to execute the read-modify-write operation with high speed in the conventional device by increasing the capacity of the data bus used.

However, increase in the capacity of the data bus leads to an increase in size and a rise in the cost of the entire device relative to the amount of information to be dealt with, and this will make the device unsuitable for practical use.

(B) The latter type of conventional device, namely, the device for coloring figures in the reverse order of priority, is disadvantageous in that the figure of highest priority is sometimes not displayed on the CRT.

In the conventional device of this type, figures are successively colored out according to the data from the figure having a low priority to the figure having a high priority, in the same manner as when coloring a picture in many layers. In this way, a plurality of figures are displayed with overlapping portions.

Therefore, since this device dispenses with the above-described read-modify-write operation, the entire circuit is simplified and the coloring out process can be executed at comparatively high speed.

On the other hand, if data write time is in short supply for one reason or another, it is impossible to write the figure of the highest priority into the memory, and, as a result, the figures having lower priorities alone are displayed on the CRT, the figure of the highest priority being omitted.

(C) Both of these conventional devices which use the bit-map-display technique inconveniently require a very large memory capacity.

Use of the bit-map-memory technique requires a large-capacity bit-map-memory having memory areas which correspond to all the pixels of the CRT.

Specifically, in order to display a desired colored image on the CRT, a memory capacity equivalent to the number of pixels multiplied by the number of color information bits for color display is necessary. Thus, the memory capacity used inconveniently becomes extremely large.

SUMMARY OF THE INVENTION

Accordingly, it is an object of the present invention to eliminate the above-described problems in the prior art and to provide an image synthesizer which is capable of synthesizing and outputting an image signal at the real time without omitting a figure having high priority.

To achieve this aim, an image synthesizer according to the present invention comprises:

an outline point information storing means for successively writing and storing outline point information which consists of the positions of pairs of right and left outline points at which the outline of a figure for CRT display intersects respective horizontal scanning lines and additional data on this figure in the order of priority in respective horizontal scanning memory areas which are provided in correspondence with the respective horizontal scanning lines;

a line processor circuit for successively reading the outline point information in synchronization with a horizontal scanning signal from the horizontal scanning memory area which corresponds to a vertical scanning position; and a line buffer having memory areas of a number which at least corresponds to the number of pixels for one horizontal scanning, the additional data contained in the outline information which has been read from the horizontal scanning memory area being successively written in the memory areas which are defined by the corresponding pair of outline points;

the line processor circuit including a vacant area detection unit for detecting a vacant area in the line buffer at the real time during each horizontal scanning period, a data read unit for successively reading outline point information in synchronization with the horizontal scanning signal from the horizontal scanning memory area which corresponds to the vertical scanning position, and a data write unit for writing the additional data in the vacant area in the line buffer which is defined by the corresponding pair of outline points every time the outline point information is read;

whereby an image signal is synthesized and output through the line buffer every time the horizontal scanning signal is output.

The above and other objects, features and advantages of the present invention will become clear from the following description of the preferred embodiments thereof, taken in conjunction with the accompanying drawings.

DESCRIPTION OF THE PREFERRED EMBODIMENTS

Contents of Description of the Preferred Embodiments

A: Summary
B: Application
B1: Image Information Supply Source
* Viewpoint
* Structure
* Operation
* Additional data
* Communication memory
B2: Field Processor Circuit
* Polygon identification number
B3: Image Synthesizer
(a) Memory circuit
a - 1. Field memory
* Order for writing data
* Word structure
(b) Line buffer
(c) Line processor circuit
* Data read unit
* Data write unit
* Vacant area detection unit
* Example of coloring out operation
(c) Comparison between the image synthesizer of the present invention and a conventional device
C: Embodiments
C1: First Embodiment
(a) Specification
(b) Dual Port RAM
(c) Image information supply source
(d) Field processor circuit
* Structure
* Operation
(e) Field memory
(f) Line buffer
(g) Line processor circuit
* Readout of outline point information
* Coloring out processing
* Example of coloring out operation
* Vacant pixel
* Number of polygons displayable
* Dual port RAM
C2: Second Embodiment
* Completely discontinuous type
* Semi-discontinuous type

Embodiments

Preferred embodiments of the present invention will be explained hereinunder with reference to the accompanying drawings.

A: Summary

The present invention relates to an apparatus which is capable of synthesizing and outputting an image signal for CRT display at the real time on the basis of various pieces of figure information supplied from the outside.

Figure 2:
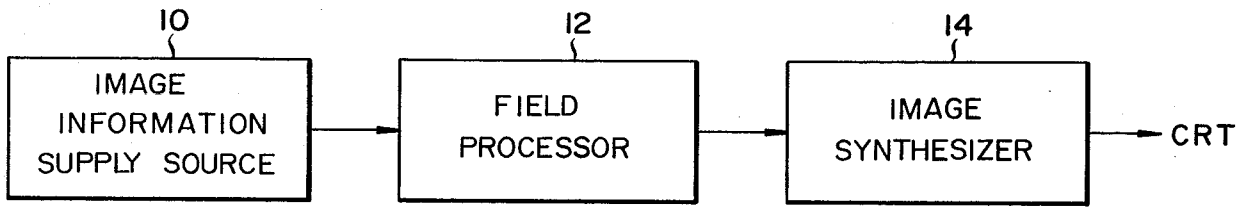
FIG. 2 is a block diagram of an image display apparatus which adopts an image synthesizer according to the present invention.

Referring to FIG. 2, an example of a pseudo-three-dimensional image synthesizing apparatus adopting an image synthesizer of the present invention is shown. The apparatus in FIG. 2 is composed of an image information supply source 10, a field processor circuit 12 and an image synthesizer 14 according to the present invention.

The image information supply source 10 deals with three-dimensional solid information, converts it into combined information on two-dimensional figures by subjecting the three-dimensional solid to various conversions such as rotation, parallel movement and central projection, and outputs it as pseudo-three-dimensional information.

The pseudo-three-dimensional information includes not only the data of the configuration, position and priority of a figure but also additional data such as a color code.

The field processor circuit 12 computes the outline of each figure to be displayed on the CRT on the basis of the pseudo-three-dimensional information which has been output in this manner. The outline points of each polygon are successively output as outline point information together with the corresponding additional data.

The image synthesizer 14 of the present invention computes and outputs a pseudo-three-dimensional image signal for CRT display at the real time on the basis of the outline point information which has been output in this way.

B: Application

Figure 1:
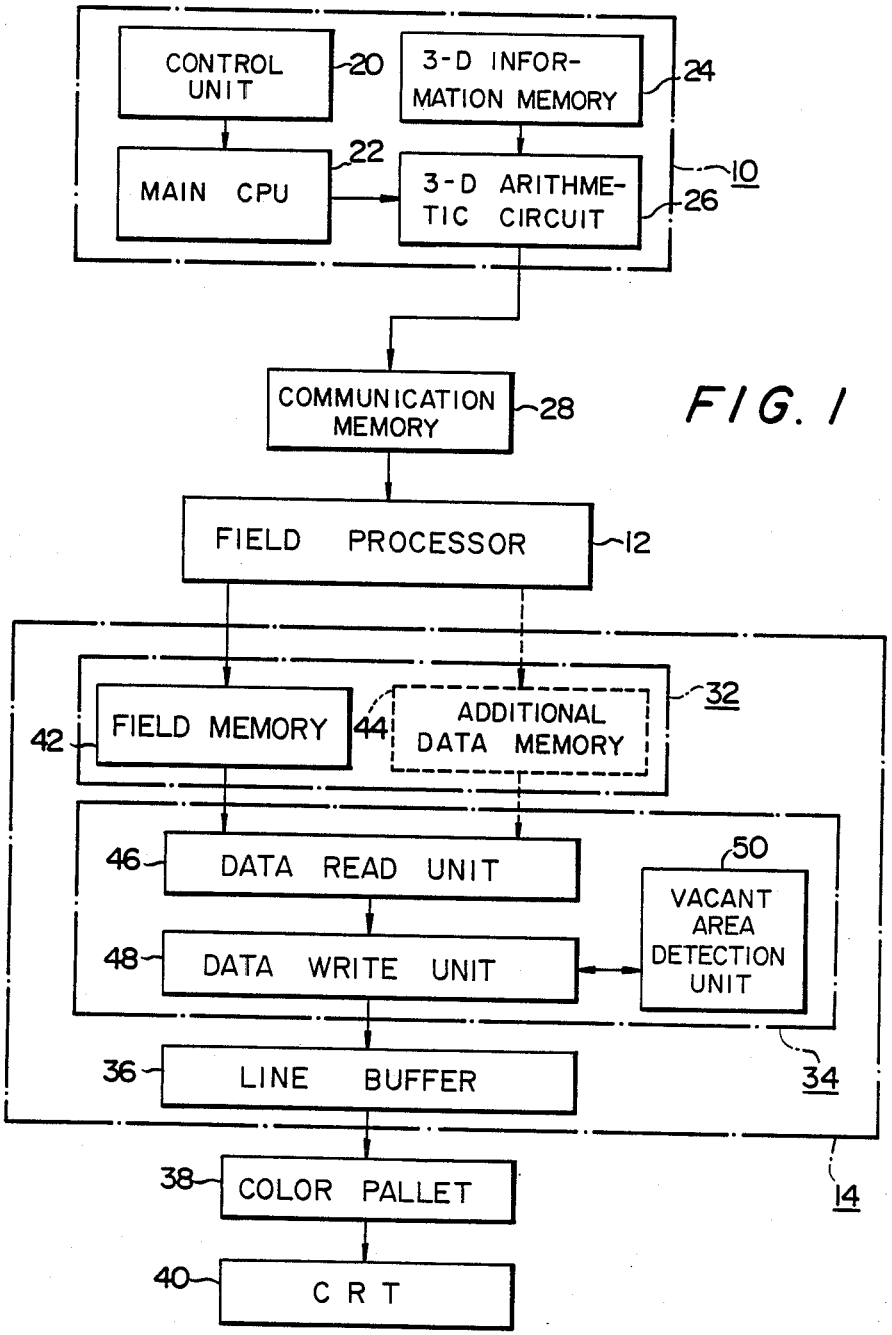
FIG. 1 is an explanatory view of the entire part of a simulator which adopts an image synthesizer according to the present invention.

FIG. 1 shows an example of a flight simulator for which the pseudo-three-dimensional image synthesizing apparatus described above is adapted.

B1 Image Information Supply Source

In this example, the image information supply source 10 computes simulation images under various flight conditions and outputs these simulation images in the form of combined information on a plurality of figures to the field processor circuit 12 through a communication memory 28.

* Viewpoint

In order to enhance the reality of the image output from the image supply source 10, it is preferable to maximize the amount of information available.

On the other hand, in order to increase the speed of operation of the image information supply source 10, the amount of information to be dealt with should be minimized.

Therefore, in order to both enhance the reality of the signal output from the image information supply source 10 and speed up the operation of the image information supply source 10, it is necessary to improve the quality of signal processing so as to obtain an image having an optimum degree of reality with as little information as possible.

This improvement is achieved by successively deleting to the extent necessary all information having a low degree of utility from the pseudo-three-dimensional information which is output from the image information supply source 10. The present applicant has made investigations on the following four points from this point of view.

Point 1

The information having the lowest degree of utility among the items of information on a three-dimensional object is the information on the interior of the object.

This is because the interior of the object is invisible and therefore can be disregarded unless it is a translucent object.

It is understood that three-dimensional image information is adequately provided for by the information on the surface of the object.

Point 2

It is possible to simplify the configuration of the surface of an object by regarding it as an aggregate consisting of a combination of "plane figures", with information about the surface details being ignored.

If the information on the surface of the object is restricted in this way to the information on "plane figures" which consists of the information about the configuration and color of the figures, it is possible to lessen the amount of information that needs to be dealt with.

Point 3

It is possible to reduce the amount of information further by restricting the information on the configuration of a figure described in Point 2 to the information on a simplified configuration such as a circle, ellipse, polygon and the like according to certain rules.

Point 4

Shapes such as a circle, ellipse, polygon, etc. are considered as the simplified configuration of a figure in Point 3. However, optional use of such a plurality of configurations not only makes the entire circuit complicated but also requires new information regarding "selection of the configuration of a figure".

It is therefore desirable to restrict the configuration of the figure used for such a combined display to one selected from among a circle, an ellipse and a polygon.

When these configurations are investigated from the point of view of display as a combination of figures of a given configuration, a polygon is the most advantageous because it has flexibility.

The image information supply source 10 of the present invention is constructed from such a viewpoint, and computes and outputs a three-dimensional object as information on a combination of a plurality of polygons.

Thus, the image information supply source 10 in the embodiment is capable of computing at high speed and outputting information necessary for the synthesis of an information signal having high reality.

*Structure

The structure of the image information supply source 10 in this example will be explained in detail hereinunder.

The image information supply source 10 in this embodiment includes a control unit 20, a main CPU circuit 22, a three-dimensional information memory 24 and a three-dimensional arithmetic circuit 26.

The control unit 20 has completely the same structure as the cockpit of an airplane, and the operation is converted into an electric signal through a switch and a variable resistor, and is output to the main CPU circuit 22.

The main CPU circuit 22 functions as the nucleus of the simulator, and computes the data indicating the position of the airplane on the basis of the signal output from the control unit 20, outputting the data to the three-dimensional arithmetic circuit 26.

The main CPU circuit 22 receives various circumstance signals indicating information such as, for example, "the airplane has collided with another object", "the airplane has entered turbulence" and "the airplane has arrived at its destination", and computes the circumstance data which corresponds to such information and outputs it to the three-dimensional arithmetic circuit 26.

In the three-dimensional information memory 24, each object is represented as a polyhedron, and three-dimensional coordinate data indicating each vertex of the polyhedron and polyhedron data indicating each surface of the polyhedron as a combination of each vertex are written and stored. The data on the polyhedron is represented by using a fixed coordinate system.

The three-dimensional arithmetic circuit 26 computes the scene seen from the airplane with reference to each item of data on various polyhedrons stored in the three-dimensional memory 24 on the basis of the present position of the airplane computed by the main CPU circuit 22. The scene is output to the communication memory 28 as a combination of figure information.

* Operation

The computation of such information on a polyhedron is executed in the following steps.

Figure 3:
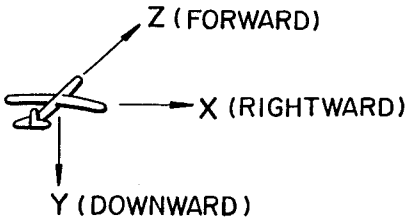
FIG. 3 is an explanatory view of an example of a moving coordinate system which is used in an image information supply source.

As shown in FIG. 3, the three-dimensional arithmetic circuit 26 assumes a moving coordinate system with the airplane as the origin, and the rightward direction in FIG. 3 is set at the X coordinate, the downward direction at the Y coordinate and the forward direction at the Z coordinate.

When the moving coordinate indicating the present position of the airplane is outputted from the main CPU circuit 22, the three-dimensional arithmetic circuit 26 reads data on a predetermined polyhedron from the three-dimensional information memory 24.

In this example, since the information written in the three-dimensional information memory 24 is represented by using the fixed coordinate system, the three-dimensional arithmetic unit 26 must convert the information read from the memory 24 to coordinate data of the moving coordinate system.

This conversion is realized by a combination of two arithmetic elements of the rotation and the parallel movement of the coordinates. During this conversion process, information ($z<0$, etc.) which has proved to beyond the vision of the pilot is removed. The circumference data obtained by the conversion are output to the main CPU circuit 22.

The information on each polyhedron is center projected to a viewpoint of $z<0$ on the assumption that the display is on the plane of $z=0$.

The data on each polyhedron is represented as a set of point information obtained by converting the coordinates of each vertex into the two-dimensional X and Y coordinates. Before such central projection is carried out, the distance between the viewpoint and the coordinate of each vertex of a polyhedron has been obtained.

The two-dimensional point information obtained by the central projection is classified as a polygon which represents the surface of a polyhedron, and judgment is made as to whether or not the classified polygon is within the view of the pilot, namely, the display.

The field processor circuit 12 and the image synthesizer 14 in this example are set such that the acceptable coordinate range is a little wider than the pilot's view.

Consequently, the three-dimensional arithmetic circuit 26 checks the information obtained for every polygon, and appropriate modification is imparted to each polygon so that a polygon which is out of view is removed, and a polygon which is only partially within view may be admitted into the acceptable coordinate range.

The three-dimensional arithmetic circuit 26 thereafter determines a typical value of the distance from the viewing point with respect to a polygon which is within the acceptable coordinate range.

The information on the polygons is successively output to the communication memory 28 as information on polygons having higher priority in the order which is reverse to that of the typical values.

*Additional data

The information on each polygon output to the communication memory 28 includes not only the two-dimensional coordinate data (X, Y) on each vertex of a polygon but also additional data.

The additional data include, for example, the color code and brightness information of a polygon, and the Z axis coordinate value of the polygon which is useful for synthesis with another image. In addition, if, for example, the inclination of the polygon is given as additional data, it is possible to determine the luminosity of the polygon by a later computation on the basis of the inclination of the surface and the direction of light.

In this example, for the purpose of simplifying the explanation, it is assumed that a color code alone is output as the additional data.

As described above, the image information supply source 10 in the example converts the scene within view of the pilot into a combination of information on a plurality of polygons, and successively outputs the information on the polygons in the order of priority to the communication memory 28.

* Communication memory

The communication memory 28 functions as the interface between the image information supply source 10 and the field processor circuit 12, and successively outputs the polygon information output from the image information supply source 10 in the order of priority to the field processor circuit 12.

B2: Field Processor Circuit

The field processor circuit 12 functions as a means for computing outline point information and computes and outputs the outline of a polygon to be displayed on the CRT on the basis of the polygon information which has been input.

In the example, the polygon information which is successively output from the image information supply source 10 in the order of priority is updated in synchronization with the field scanning (scanning of the field of an even number or an odd number) of the CRT.

For this reason, the field processor circuit 12 in the example is operated with the field scanning time as one period, and the polygon information input during this period is stored in the internal register in the order of priority.

Therefore, if it is assumed that the polygon information indicating polygons A, B and C is successively output, as shown in FIG. 4(A), the field processor circuit 12 first reads the X, Y coordinate data indicating the respective vertex a1, a2, a3 and a4 of the figure A having the highest priority and the additional data (color code) on the figure A as the polygon information on the figure A, and stores it in the internal register.

On the basis of the vertex coordinate data contained in the polygon information which has been read in this way, the positions of the outline points at which the outline of the figure A intersects the respective horizontal scanning lines of the CRT are computed.

Assuming that if there is a figure which intersects one scanning line, at least two outline points of the figure exist on the scanning line (except the vertices of a polygon), these two outline points are defined as the "left outline point" and the "right outline point" depending on their respective position, and the two are defined in combination as "a pair of outline points".

In a typical polygon, only one pair of outline points exist on one scanning line, but plural pairs of outline points may exist in the case of a special concave polygon.

The field processor circuit 12 in the example collects the position of each outline point obtained by computation as a pair of outline points for each scanning line.

The outline point information including each pair of outline points and the additional data on the figure is output to the image synthesizer 14.

Thereafter, the field processor circuit 12 successively computes the outline point information on the figures B and C in the same way, and outputs the outline point information obtained to the image synthesizer 14.

In this way, the outline point information consisting of each pair of outline points of the polygons A, B and C and the additional data is successively computed by and output from the field processor circuit 12 in the example in the order of priority.

* Polygon identification number

The field processor circuit 12 in this example produces the polygon identification numbers which correspond to the polygons A, B and C, respectively, if an additional data memory 44 is provided in a later-described memory circuit 32. The identification numbers are output to the memory circuit 32 together with the positions of pairs of outline points and the additional data.

B3: Image Synthesizer

The image synthesizer 14 of the present invention synthesizes and outputs an image signal for CRT display on the basis of the outline point information on the polygons A, B and C which are input in the order of priority as described above.

In the present invention, the image synthesizer 14 includes the memory circuit 32, a line processor circuit 34 and a line buffer 36.

(a) Memory circuit a - 1. Field memory

The memory circuit 32 in this example functions as an outline point information storing means, and is generally constituted by a field memory 42. The memory circuit 32 stores the outline point information on all polygons to be displayed in one frame of the CRT 1.

FIG. 4(B) schematically shows the field memory 42. The memory space is divided into horizontal scanning memory areas of the same number as the number of scanning lines which constitute one frame such that the horizontal scanning areas have one-to-one correspondence with respect to the scanning lines. An address which corresponds to the Y coordinate is given to each memory area.

Thus, the outline point information on the polygons A, B and C is successively written in vacant areas in the horizontal scanning memory areas which correspond to the respective Y coordinates.

* Data writing order

The image synthesizer of the present invention establishes the priority of each of the polygons A, B and C in the order in which the outline point information is written in the horizontal scanning memory area.

The field processor circuit 12 in this example outputs the outline point information on the polygons A, B and C in that order, namely, in the order of priority. Therefore, in each horizontal scanning memory area in the field memory 42 in this example, the outline point information on the polygon A which has the highest priority is first written, and the outline point information on the polygons B and C are thereafter written in that order.

For example, in the horizontal scanning memory area designated by Y=20, the outline point information on the polygons A, B and C is written in the order of the address with the lowest number.

* Word structure

Each item of outline point information consists of the X coordinate XL of the left outline point, the X coordinate XR of the right outline point and additional data on the polygon.

Any word structure in each horizontal scanning memory area enables such polygon information to be written, but the following three structures will be considered as practical word structure forms.

(1) One word is used for storing one piece of outline point information, and the position of the left outline point, the position of the right outline point and the additional data, which together constitute the outline point information, are all stored in one word.

(2) Two words are used for storing one piece of outline point information. The position of the left outline point is allocated to one word and the position of the right outline point is allocated to the other word. The additional data is equally divided into two and allocated to the respective words.

(3) Three words are used for storing one piece of outline point information. The position of the left outline point, the position of the right outline point and the additional data are separately stored, each in one of the words.

Any of the above-described word structures may be adopted in this example; it goes without saying, however, that the fewer the words used, the more rapid the access to the data is.

The methods of writing the outline point information by means of the field processor circuit 12 vary depending upon which of the word structures (1) to (3) is adopted.

When the word structure (1) is adopted, three writing methods may be considered.

A first method is a method of successively writing outline point information from outline point information in which a pair of outline points are obtained in the process of computing the outline points of one polygon.

In this case, a memory for temporarily storing one outline point is necessary. The outline point which has been first obtained is temporarily stored in this memory and when the other outline point is obtained, both outline points are written and stored as the positions of the pair of outline points.

A second method adopts a read-modify-write technique.

In this method, when one outline point is obtained in the process of computing the outline points of a polygon, it is immediately written together with the additional data. When the other outline point is obtained, the position of the outline point which has previously been written is read, and is written again together with the position of the outline point newly obtained.

The additional data may be written either at this time, or at another time.

A third method is different from the other two methods in regard to the process for obtaining the outline points of a polygon. In this method, the right and left outline points are simultaneously obtained with the maximum or minimum point as the starting point, and are written together with the additional data. In this method, the circuit for computing the outline points becomes rather complicated.

In the case of adopting the word structures (2) and (3), the field processor circuit 12 computes an outline point of a polygon and immediately it is obtained in that process, it is written. In particular, when the word structure (3) is adopted, it is necessary to write the additional data alone in the corresponding word separately from the positions of the outline points.

a -2. Additional data memory

The additional data is written in the field memory 42 together with the positions of a pair of outline points, as a rule, as described above.

However, since the structure of the field memory 42 for storing the additional data is redundant, when the number of bits of the additional data is large, it is preferable to provide an additional data memory 44 for exclusive use.

In this case, the field processor circuit 12 outputs a polygon identification number as well as the position of a pair of outline points and the additional data as the outline point information.

The additional data is written in the additional data memory 22 with the polygon identification number as the address.

On the other hand, the polygon identification number is written in the field memory 42 in place of the additional data.

Generally, the additional data are simple data having a small number of bits such as color information and brightness information, and in such case no additional data memory 44 may be required.

However, if the additional data include the Z axis coordinate value for synthesizing polygons with each other and other information on special functions, the number of bits constituting the additional data becomes so large that the additional data memory 44 is required, (b) Line buffer The line buffer 36 has at least the same number of additional data memory areas as the number of pixels for one horizontal scanning so as to allow the additional data contained in the outline point information to be written in each memory area.

Figure 5:
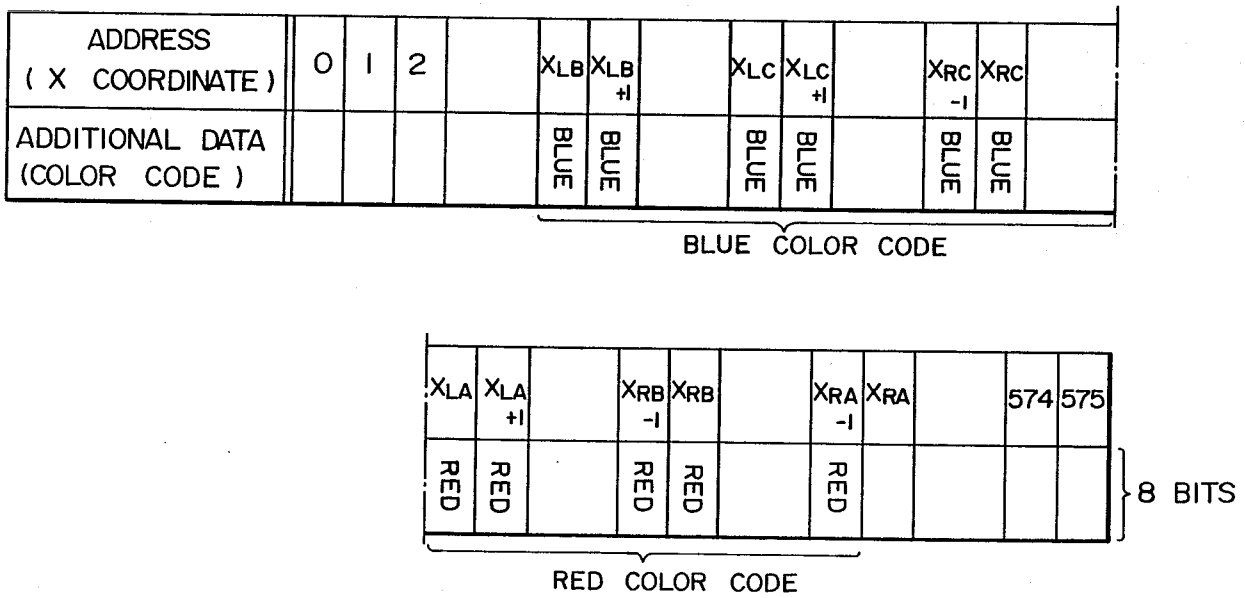
FIGS. 5(A) and 6(A) are schematic explanatory views of a line buffer which is used in the present invention.
FIGS. 5(B) and 6(B) are schematic explanatory views of a vacant area detection unit which is used in the present invention.
Figure 6:
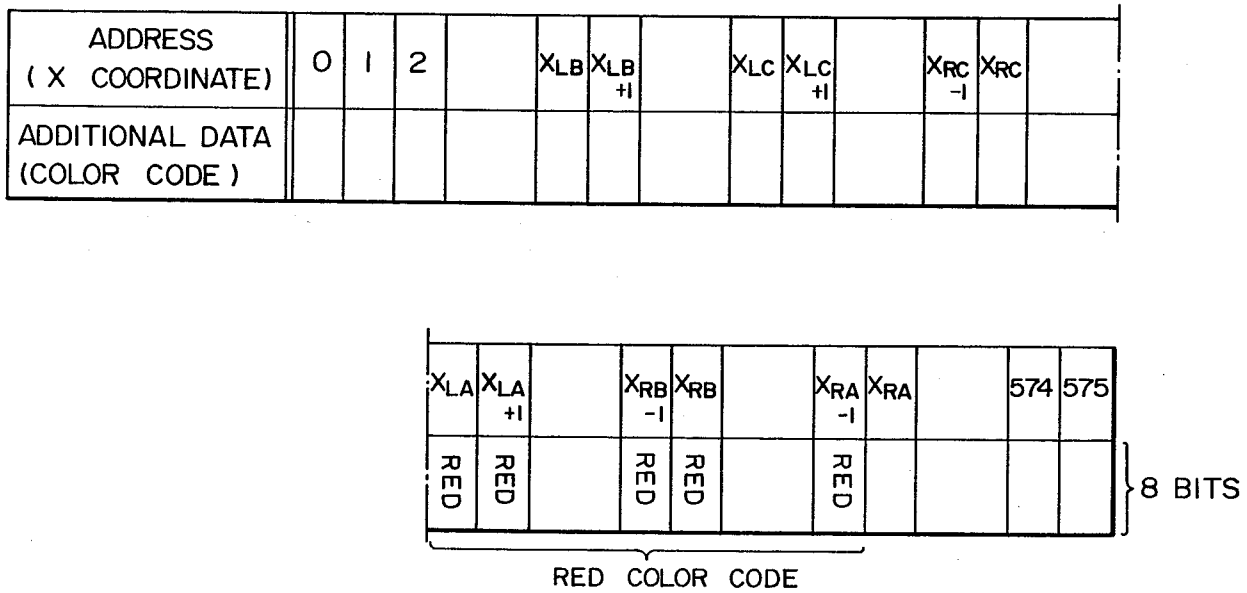

FIGS. 5(A) and 6(A) show the format of the line buffer 36 in the example.

The line buffer 36 in the example is so composed that when a later-described line processor circuit 34 reads each piece of outline point information (additional data, the position XL of the left outline point, and the position XR of the right outline point) in synchronization with a horizontal scanning signal from the horizontal scanning memory area which corresponds to the vertical scanning position, the additional data contained in the outline point information is written in the address defined by the pair of outline points (XL, XR).

Therefore, if the additional data of, e.g., the polygons A, B and C represent the color codes of red, blue and yellow, respectively, the color codes of red, blue and yellow are written in the respective predetermined areas of the line buffer 36.

(c) Line processor circuit

The line processor circuit 34 successively reads the outline point information on the respective polygons from a predetermined horizontal scanning memory area in synchronization with the horizontal scanning of the CRT in the order of priority.

The additional data are successively written in the memory area of the line buffer 36 which is defined by the positions XL of the corresponding left outline points and the positions XR of the corresponding right outline points.

In the present invention, the line processor circuit 34 includes a data read unit 46, a data write unit 48 and a vacant area detection unit 50.

* Data read unit

The data read unit 46 successively reads the outline point information on the respective polygons in synchronization with the horizontal scanning from the horizontal scanning memory area which corresponds to the vertical scanning position in the order of priority.

For example, if the line Y=20 is horizontally scanned, the data read unit 46 first reads the outline point information on the polygon A, and next the outline point information of the polygon B, and then that on the polygon C from the horizontal scanning area of Y=10 in the field memory 42.

* Data write unit

Every time the outline point information is read out, the data write unit 48 writes the additional data in the memory area of the line buffer 36 defined by the pair of outline points (XL, XR).

At this time, the data are written, in other words, the additional data are colored out in the line buffer 36 in the order in which the outline point information has been read, so that the additional data having a higher priority is written in the line buffer 36 prior to that having a lower priority.

Therefore, it is necessary to write the additional data which is to be written later in the line buffer 36 only in a vacant area (hereinunder referred to as "vacant pixels") so as to prevent the data from being written over the previously written additional data.

* Vacant area detection unit

If such a vacant pixel in the line buffer 36 is detected by what is called a read-modify-write technique, it is impossible to speed up the operation of the entire circuit.

Accordingly, the line processor circuit 34 in the present invention uses the vacant area detection unit 50 to detect a vacant pixel in the line buffer 36 at high speed during horizontal scanning.

FIGS. 5(B) and 6(B) show the format of the vacant area detection unit 50. The detection unit 50 is set at "0" if the corresponding pixel in the line buffer 36 is a vacant pixel, while it is set at "1" if the corresponding pixel has been colored.

Every time outline point information is read out, the data write unit 48 writes the additional data in vacant pixels in the line buffer 36 which are defined by the position XL of the left outline point and the position XR of the right outline point on the basis of the vacant pixel information supplied from the vacant area detection unit 50.

Simultaneously with this, the vacant area detection unit 50 detects the fact that the new additional data has been written in the vacant pixels defined by the positions of these right and left outline points.

* Example of coloring out operation

Figure 4:
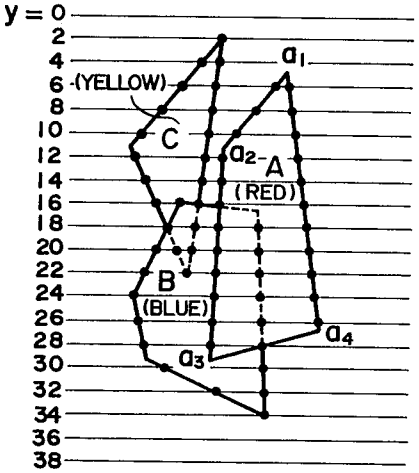
FIGS. 4(A) and 4(B) are explanatory views which show the relationship between outline point information and a field memory.
Figure 4:
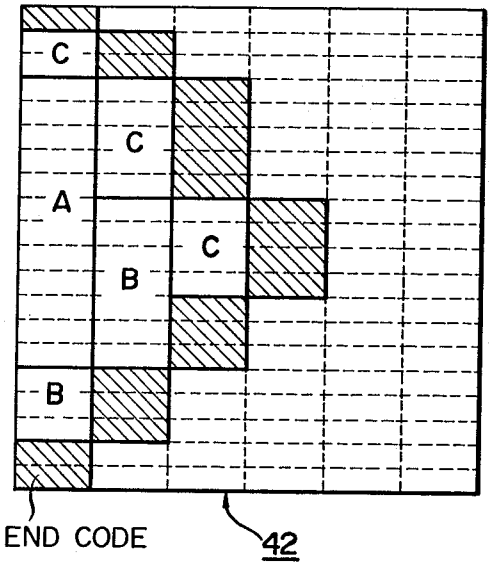

If, for example, the line Y=20 shown in FIG. 4 is horizontally scanned and the outline point information on the polygons A, B and C includes as additional data the color codes of red, blue and yellow, respectively, the line processor circuit 34 first reads the outline point information on the polygon A from the horizontal scanning memory area of Y=20 in the field memory 42.

The memory area of the line buffer 36 defined by the position XLA of the left outline point and the position XRA of the right outline point which are contained in the outline point information is first colored out with a red color code, as shown in FIG. 6(A). At the same time, the vacant area detection unit 50 detects the vacant areas except the area defined by the position XLA of the left outline point and position XRA of the right outline point as the presently vacant pixels in the line buffer 36, as shown in FIG. 6(B).

When the coloring operation of the polygon A is completed in this way, the field processor 34 similarly reads the outline point information on the polygon B having the second highest priority, and the memory area defined by the position XLB of the left outline point and the position XRB of the right outline point contained in the outline point information is colored out by a blue color code, as shown in FIG. 5(A).

The coloring out operation is executed by the line processor circuit 34 only with respect to the vacant pixels alone (FIG. 6(B)) detected by the vacant area detection unit 50 so as to prevent the blue color code from being written on the red code which has already been written.

The vacant area detection unit 50 similarly detects new vacant pixels in the line buffer 36 at the real time on the basis of the above-described writing operation, as shown in FIG. 5(B).

When the coloring out process of the polygon B is completed, the coloring out process of the polygon C is executed in the same manner.

In this way, the line processor circuit 34 in this example synthesizes an image signal for one horizontal scanning by using the line buffer 36.

The image signal synthesized in the line buffer 36 in this way is input to a color pallet memory 38 in synchronization with the horizontal scanning of the CRT, and is converted to a concrete color signal based on the color codes, thereby being output to the CRT 40.

The line processor circuit 34 in this example repeats such process of synthesis, write and output of an image signal with respect to the line buffer 36 in synchronization with the horizontal scanning of the CRT 40. Thus, a simulation image output from the image information supply source 10 in this way is displayed with efficiency on the CRT 40 as a combination of polygon information.

(d) Comparison between the image synthesizer of the present invention and a conventional one (1) The synthesizer according to the present invention dispenses with what is called a read-modify-write operation of the additional data.

In an image synthesizer adopting a bit map display system, it is necessary to set the outline of an image in a bit map memory and to color the inside of the outline, in other words, what is called a "coloring out operation" is necessary.

If such coloring out processes are successively executed for the figures in the order of priority in a conventional image synthesizer, what is called a read-modify-write operation, which takes much time, is required for each process in order to prevent the information having higher priority which has previously been written from being deleted by information having lower priority which is to be written later. Therefore, it is impossible to synthesize an image in a short time.

Such a read-modify-write operation often makes it impossible for the coloring out operation to keep up with changes in image, so that it is impossible to obtain the real-time display of a rapidly moving image.

It is possible to speed up the coloring out operation by increasing the capacity of a bus line used. However, this brings about another problem since the capacity of the bus line and other members is excessively raised in comparison with the amount of information to be dealt with, resulting in an increase in size and a rise in the cost of the entire image synthesizer.

In contrast, in the image synthesizer according to the present invention, the vacant area detection unit 50 detects a vacant area in the line buffer 36 for coloring out with the additional data. Unlike a conventional image synthesizer, therefore, the coloring out operation of the additional data requires no read-modify-write operation, which takes much time, thereby enabling high-speed image synthesis.

Specifically, when no rad-modify-write operation of the additional data is carried out, the amount of computation of data required at the time of image synthesis is very small. Thus, it is unnecessary to increase the capacity of the bus line and it is possible to synthesize an image signal at the real time.

(2) The image synthesizer according to the present invention enables a reduction in the memory capacity used.

A conventional image synthesizer requires a bit map memory for storing the additional data which corresponds to at least all the pixels for one frame.

In the image synthesizer according to the present invention, however, the function of the bit map memory is divided into two; the field memory being used for storing image information for one frame, while the line buffer is used for the coloring out operation.

Since the field memory has no correspondence with the pixels, one with a smaller capacity than the bit map memory sufficies. On the other hand, although the line buffer has a correspondence with the pixels, one with a capacity for one or two scanning lines is sufficient.

Thus, it is possible to make the total memory capacity smaller than the capacity of the bit map memory.

(3) The image synthesizer according to the present invention is capable of synthesizing and outputting an image signal with high efficiency without omission of a figure having a high priority.

As a device using no read-modify-write technique, a device for successively coloring out figures in the reverse order of priority has conventionally been known.

Such a conventional device has the following critical defect: if data write time is in short supply for one reason or another, it is impossible to write the figure of the highest priority into the memory and, as a result, the figures having lower priorities alone are displayed on the CRT with the figure of the highest priority omitted.

In contrast, the image synthesizer according to the present invention is so constructed that the outline point information on the polygons A, B and C is successively written in the respective horizontal scanning lines in the field memory 42 in the order of priority and the outline point information written in this way is successively read from the line processor circuit 34, also in the order of priority.

Therefore, even if data write time is in short supply for one reason or another, it is possible to synthesize and output an image signal with high efficiency without omitting the figure of highest priority.

(4) The image synthesizer according to the present invention is capable of synthesizing and outputting a pseudo-three-dimensional image having high reality at the real time.

In the image synthesizer according to the present invention, the configuration of the surface of a three-dimensional object is treated as an aggregate of a plurality of polygons in order to display a pseudo-three-dimensional image.

Therefore, the image synthesizer according to the present invention is capable of synthesizing and outputting a pseudo-three-dimensional image having higher reality with less information and a smaller memory capacity than the conventional devices, as described above.

C: Embodiments

Embodiments of an image synthesizer according to the present invention will be explained in detail hereinunder.

C1: First Embodiment

An embodiment of an image synthesizer is so constituted as to display 64 polygons per horizontal scanning line according to the following specification.

(a) Specification

| | |
|---|---|
| (1) CRT (interlace) | |
| Number of pixels: | 576 × 448 (576 × 224/field) |
| Number of scanning lines: | 525 (262.5/field) |
| Vertical synchronization frequency: | 60.015 Hz (vertical period 16.663 ms) |
| Horizontal synchronization frequency: | 15.745 KHz (horizontal period 63.447 μs) |
| Dot clock frequency: | 12.288 MHz |
| (2) Number of polygons displayed (one frame): 1,024 | |
| (3) Number of polygons displayed (horizontal): 64 | |
| (4) Coordinate range of input information $0 \leqq X \leqq 4095$, $0 \leqq Y \leqq 1471$ | |
| (5) Coordinate range displayed $2048 \leqq X \leqq 2623$, $1024 \leqq Y \leqq 1471$ (on the circuit it is assumed that $0 \leqq X \leqq 575$, $0 \leqq Y \leqq 447$) | |

(b) Dual port RAM

Each memory of the image synthesizer in this embodiment such as, for example, the communication memory 28, the field memory 42 and the line buffer 36 preferably adopts what is called a dual port RAM in which the data write operation by the processor in a former stage and the data readout by the processor in a later stage are executed independently of each other.

Each dual port RAM used in this embodiment has twice the memory capacity required for a write and read operation, and the memory space is divided into two memory areas.

The two memory areas are alternately accessed by the processor in the former stage and the processor in the latter stage at a predetermined period.

Accordingly, in the dual port RAM, while data is being written in one memory area, the data which has been written is read from the other memory area, and while data are being read from one memory area, new data is written in the other memory area.

Table 1 shows the switching period for each memory.

TABLE 1

| Memory | Switching period |
|---|---|
| Communication memory | Field |
| Field memory | Field |
| Line buffer | Line |

(c) Image information supply source

In this embodiment, the image information supply source 10 successively outputs polygon information in the order of priority in synchronization with the field scanning of the CRT.

For example, when the image shown in FIG. 4(A) is displayed on the CRT, the polygon information on the polygons A, B and C is successively supplied in that order according to the priority.

Each piece of information output in this way contains the additional data and vertex coordinate data (X, Y) on the corresponding polygon.

In this embodiment, the additional data consists of a color code indicating the color of the polygon to be displayed. The color code functions as an address for reading a color signal from the color pallet memory 38.

Figure 7:
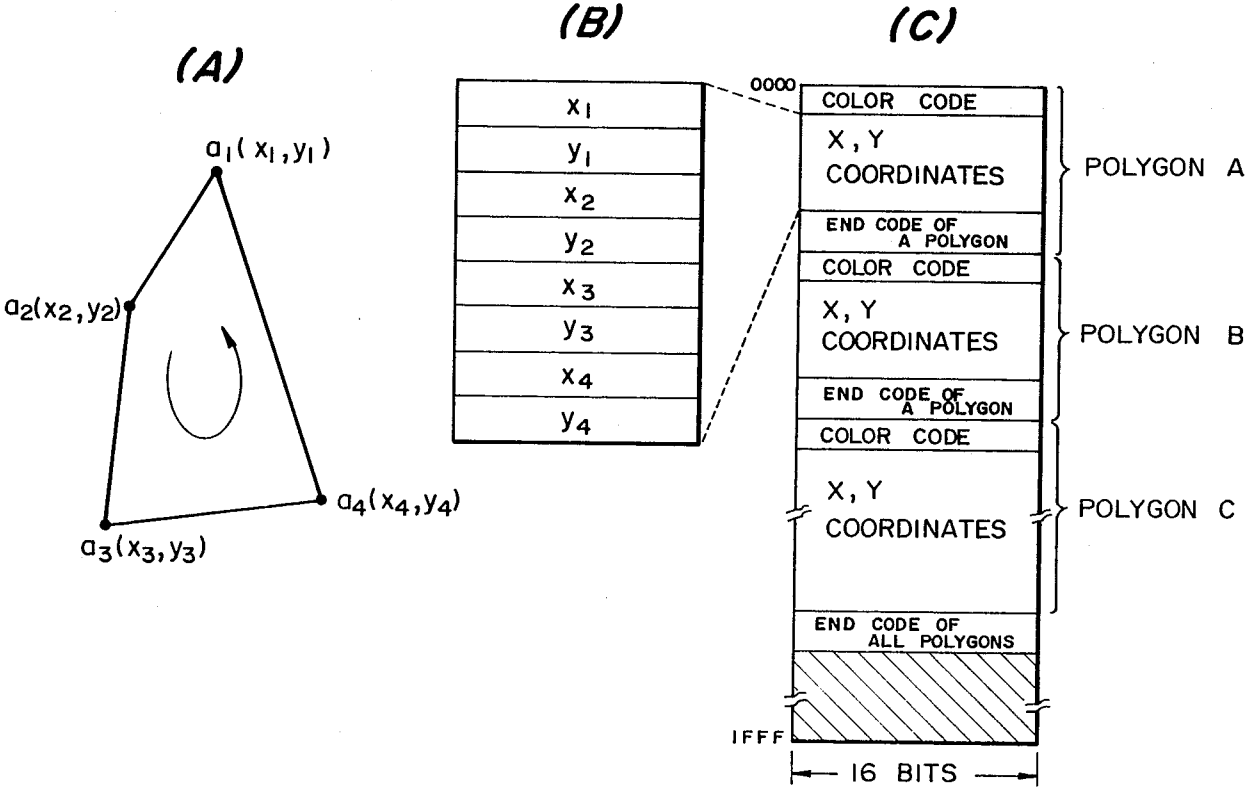
FIGS. 7(A), 7(B) and 7(C) are explanatory views of the structure of a communication memory.

It is necessary to output the vertex coordinate data of each polygon in the order of a1, a2, a3 and a4, namely, counterclockwise around the outline of the polygon, as shown in FIG. 7(A), in order that the field processor circuit 12 may display the function of removing a polygon having a reversed configuration, as will be described later.

In this manner, the polygon information on the polygons A, B and C is written in the communication memory 28 in the order of priority.

(d) Field processor circuit

Figure 8:
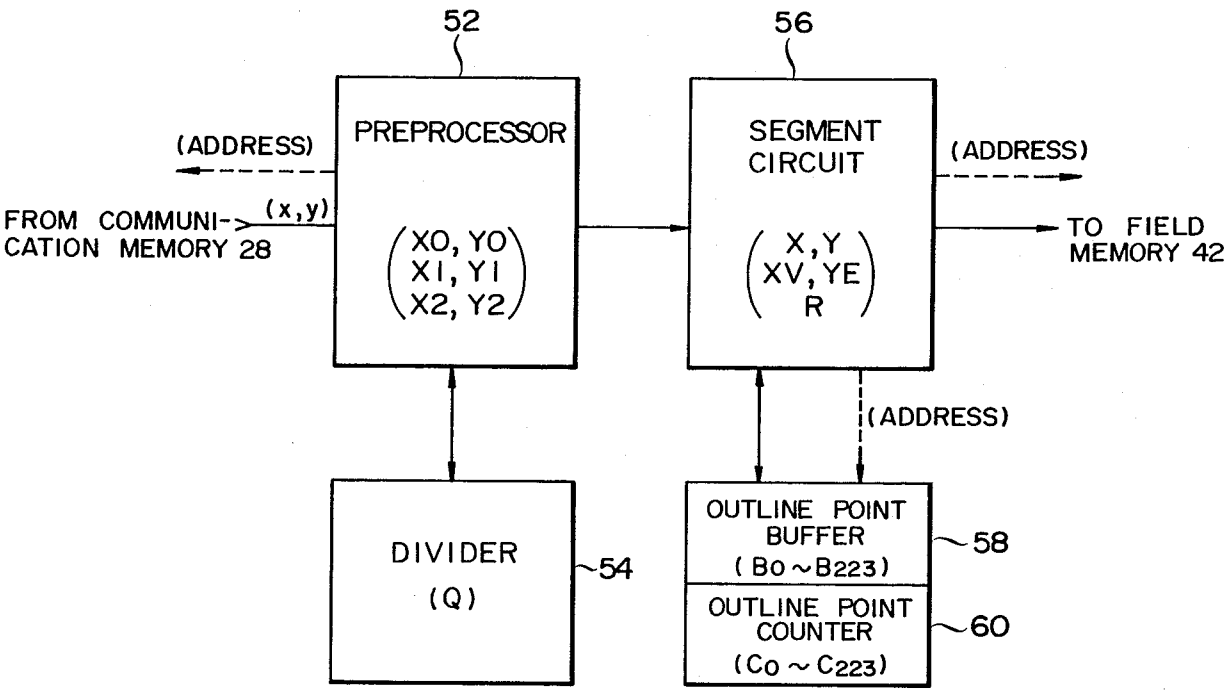
FIG. 8 is an explanatory view of the concrete structure of a field processor circuit.

FIG. 8 concretely shows the structure of the field processor 12 in this embodiment.

Structure

The field processor circuit 12 includes a preprocessor circuit 52, a division circuit 54, a segment circuit 56, an outline point buffer 58 and an outline point counter 60.

The preprocessor circuit 52 successively reads out the polygon information written in the communication memory 28, for example, as shown in FIG. 7(C) in the order of the polygons A, B and C according to the priority.

The polygon information read out in this way is classified as information on each side and output to the segment circuit 56. The division circuit 54 is used for computing the inclination of each side of a polygon.

The segment circuit 56 first computes the pairs of outline points of the polygon A having the highest priority, secondly those of the polygon B, and thirdly those of the polygon C, on the basis of the data input from the preprocessor circuit 52.

The computed pairs of outline points are successively written in the field memory 42 together with the color code.

The outline point buffer 58 is used to temporarily store the outline point previously obtained before one pair of outline points are obtained.

The outline point counter 60 is used as a register group for counting the number of the outline points on each horizontal scanning line.

Therefore, half the count value of the outline point counter 60 is equivalent to the number of pairs of outline points displayed on one horizontal scanning line. That is, the outline point counter functions as the write pointer with respect to each horizontal scanning memory area of the field memory 42.

The least significant bit of the count value is used as a flag for indicating whether a pair of outline points has been completed, or whether only one of the pair has been obtained.

Operation

FIGS. 9 to 13 are flow charts of the field processor circuit 12.

The following several variables are used in the flow charts, most of the variables indicated by capital letters denoting actual registers, and those indicated by small letters denoting numerical values output on the bus line.

X, Y: X and Y coordinate values of each vertex contained in polygon information

X0, Y0: coordinate value of the first vertex of a polygon

X1, Y1: coordinate value of the starting point of a side (as a directed segment)

X2, Y2: coordinate value of the end point of a side (as a directed segment)

Q (Quotient): result of division, namely, the gradient of a side

X, Y: coordinate value of outline point

YE (Y End): Y coordinate value of the plotting end point of a side

XV (X Visible): X coordinate of an outline point on a display

BR (Buffer): Outline buffer which corresponds to the scanning line NO. R

CR (Counter): Outline counter which corresponds to the scanning line NO. R

Figure 9:
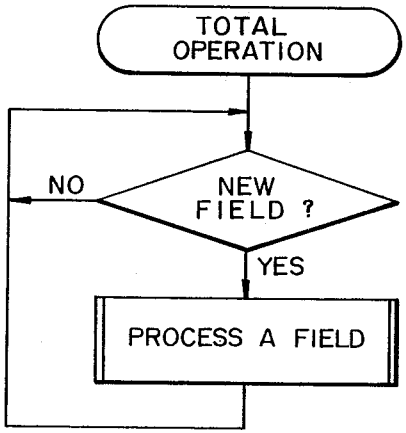

FIG. 9 is a flow chart of the total operation of the field processor circuit 12. The field processor circuit 12 repeats a predetermined field processing for each new field scanning.

In the field processor circuit 12 in this embodiment, immediately a new field scanning is started, the count values C0, C1, C2, . . . C223 of the counter 60 which are set in correspondence with each of the 224 horizontal scanning lines are cleared to 0.

Polygon information is read from the communication memory 28 one piece by one piece in the order of priority to execute a predetermined processing of a polygon.

The communication memory 28 in this embodiment computes all the pairs of outline points of the corresponding polygon on the basis of the thus-read-out polygon information. Each pair of outline points is written and stored in the field memory 42 in combination with the color code as the outline point information.

For example, if the polygon information shown in FIG. 7(C) is stored in the communication memory 28, the above-described processing is first conducted with respect to the polygon A, and when the processing of the polygon A has been completed, similar processings are successively conducted with respect to the polygons B and C in that order.

When all the processings are completed to all polygons, and end code is written in each horizontal scanning memory area in the field memory 42, as indicated by the hatched lines in FIG. 4(B). To state this more concretely, the end code is written with a combination of P=0, 1, 2, . . . 223 and the count values C0, C1, C2, . . . C223, respectively, as the address.

Figure 10:
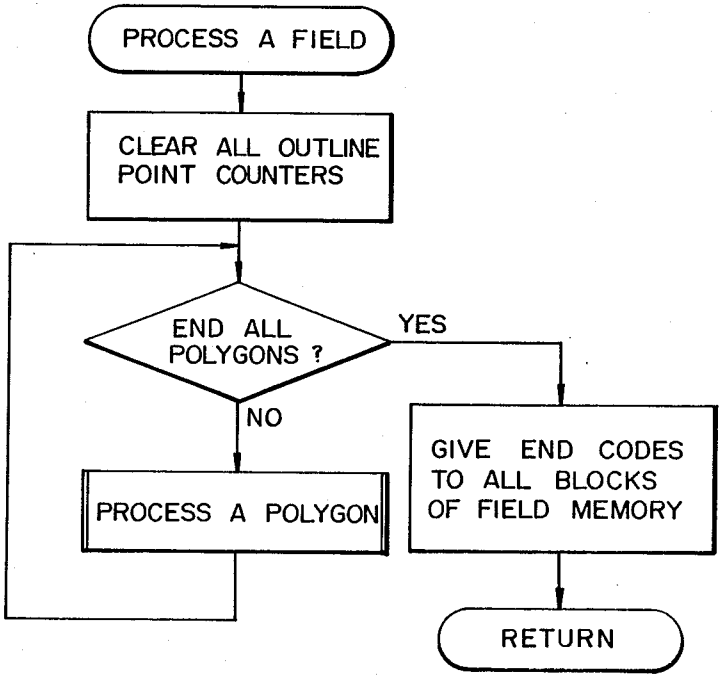
FIGS. 9, 10, 11, 12, 12A, 12B and 13 are flow charts of the operation of the filed processor circuit shown in FIG. 8.
Figure 11:
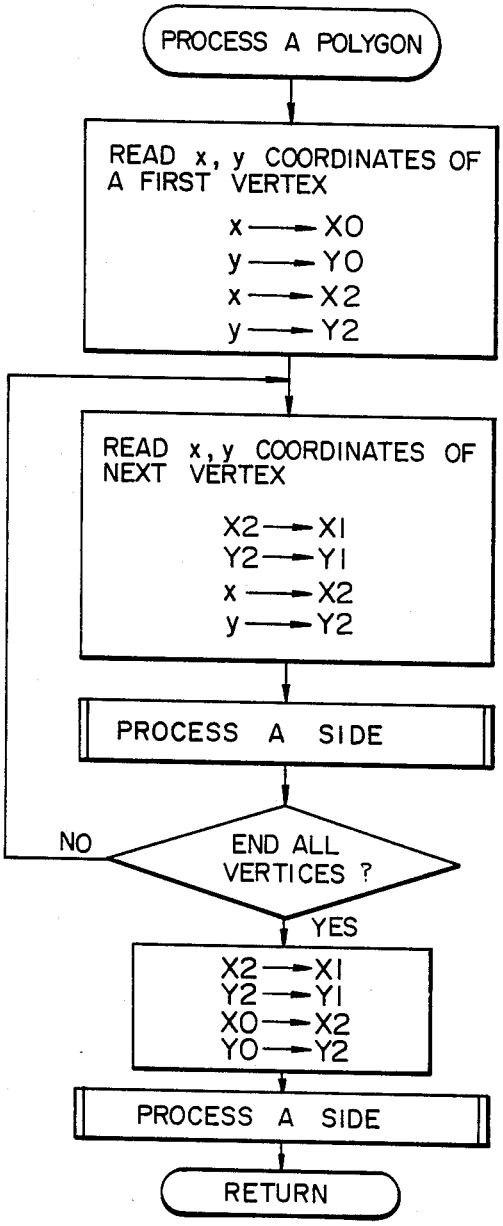

FIG. 11 is a flow chart of the processing of a polygon shown in FIG. 10.

In this embodiment, when the processing of, e.g., the polygon A is started, the X and Y coordinates of the first vertex a1 of the polygon A are read out, and the X and Y coordinates of the next vertex a2 are next read out.

X0, Y0, X1, Y1, X2 and Y2 are set by using the actual register which is so composed that when the values are set to X2 and Y2, the previously set values are automatically set at X1 and Y2, which are to be automatically deleted.

When the X and Y coordinates of the vertices a1 and a2 are read in this way, one side a1 a2 is processed on the basis of the thus-read-out information.

Such operations are successively conducted on the sides a1 a2, a2 a3, a3 a4, and a4 a1 of the polygon.

Figures 12, 12A:
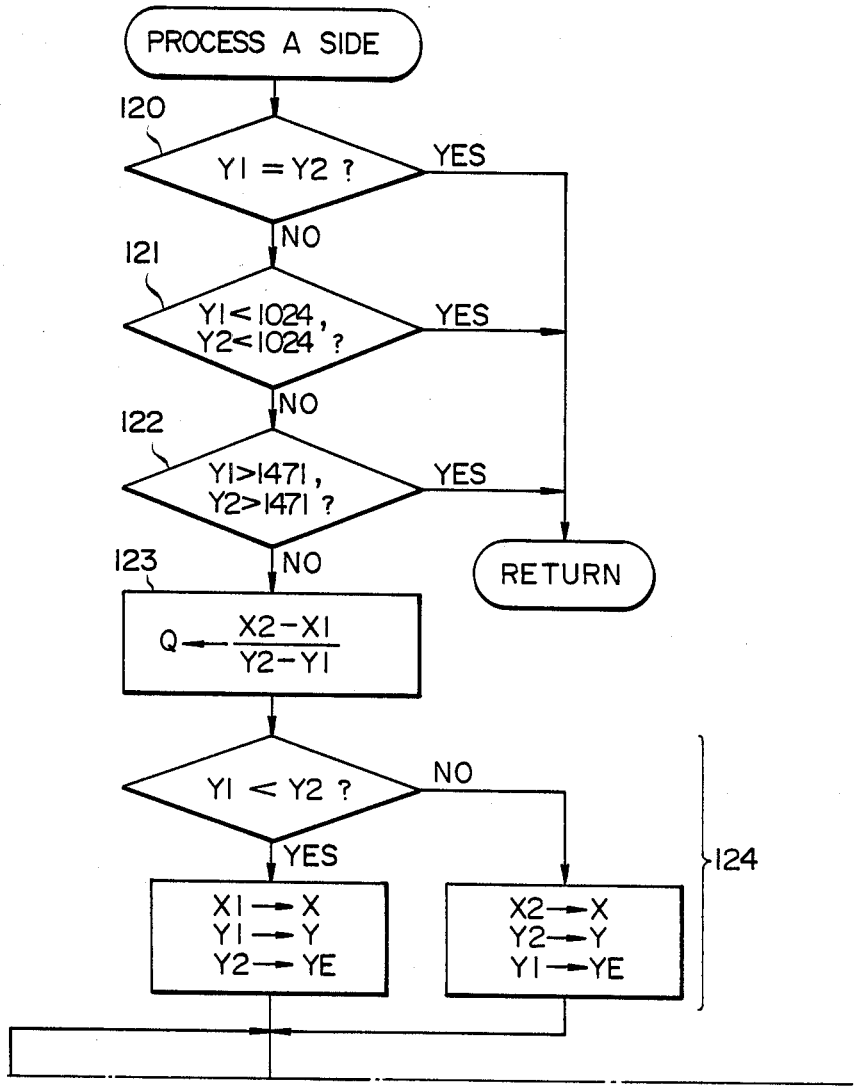
Figure 12B:
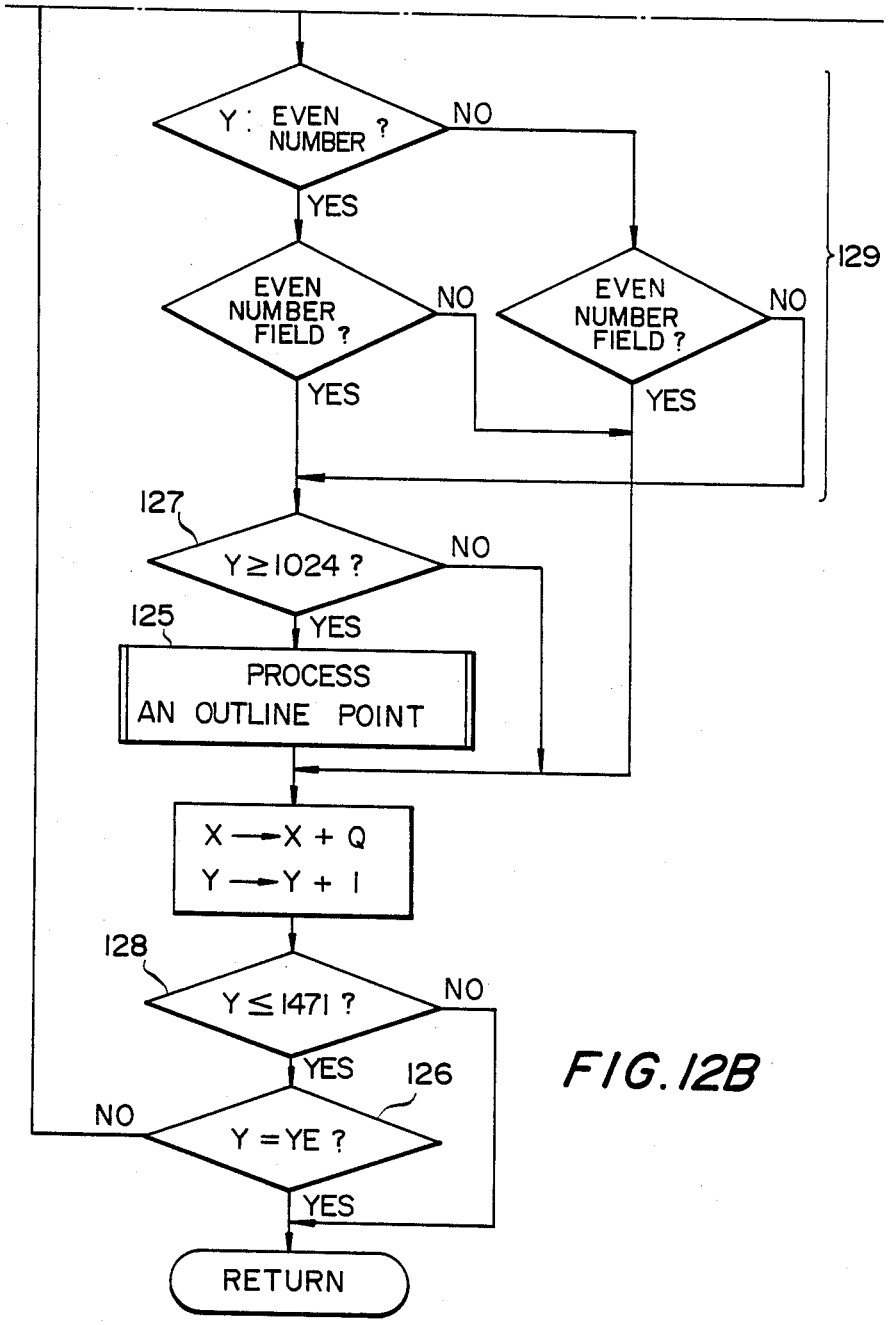

FIGS. 12A and 12B show the processing of one side shown in FIG. 11.

The field processor circuit in this embodiment judges whether or not the Y coordinates of both ends of a side to be processed agree with each other (Step 120). If the answer is Yes, judging that plotting of that side is unnecessary, the processing of it is stopped.

Judgement is next made as to whether or not the Y coordinates of the side to be processed are out of the display at all points (Steps 121, 122).

Even if the side is within the acceptable coordinate range, if the Y coordinates constituting the side are out of the display at all points, plotting of the side is judged to be unnecessary and the processing of this side is stopped (a first stage of clipping).

The field processor in this embodiment next computes the inclination Q of the side (Step 123).

At this time, although the inclination of the side actually obtained consists of an integer and a remainder, the inclination Q is assumed to be an integer in FIGS. 12A and 12B for the purpose of simplifying the explanation of the algorithm.

Thus, the formulae representing the side are set as follows:

$$X = QY + X1 - QY1$$

$$Q = \frac{X2 - X1}{Y2 - Y1}$$

It is next determined from which end of the side outline points are to be computed (Step 124). For this purpose, judgement is first made as to which of the Y coordinates of both ends Y1 and Y2 is larger and the arithmetic starting point is initially set so that the computation of an outline point is sure to be carried out in the direction in which the Y coordinate increases.

The X coordinate of an outline point, namely, the point at which the side intersects each horizontal scanning line, is computed successively from the arithmetic starting point to the arithmetic end point.

For example, in the side a1 a2 shown in FIG. 4(A), the X coordinate of the point at which the side a1 a2 intersects the horizontal scanning line of Y=6 is first obtained (Step 125). The outline points at which the side intersects the horizontal scanning lines of Y=8 and Y=10 are successively obtained.

When the Y coordinate of the horizontal scanning line agrees with the Y coordinate YE, which is set as the measurement end point, the computation of the outline points with respect to the side a1 a2 is completed (Step 126).

If the Y coordinates which interest the side a1 a2 are out of the display, it is unnecessary to obtain outline points, so that no computation of outline points is carried out at that position (second stage of clipping) (Steps 127, 128).

In this embodiment, a field of an even number and a field of an odd number are alternately scanned.

Therefore, in the field processing circuit in this embodiment, judgement is made as to whether the scanning is being carried out at present in the field of an even number or the field of an odd number. If it is the field of an even number, only the outline points which intersect the horizontal scanning lines of an even number (Y=0, 2, 4, . . . ) are computed, while in the case of the field of an odd number, only the outline points which intersect the horizontal scanning lines of an odd number (Y=1, 3, 5, . . . ) are computed (Step 129).

Figure 13:
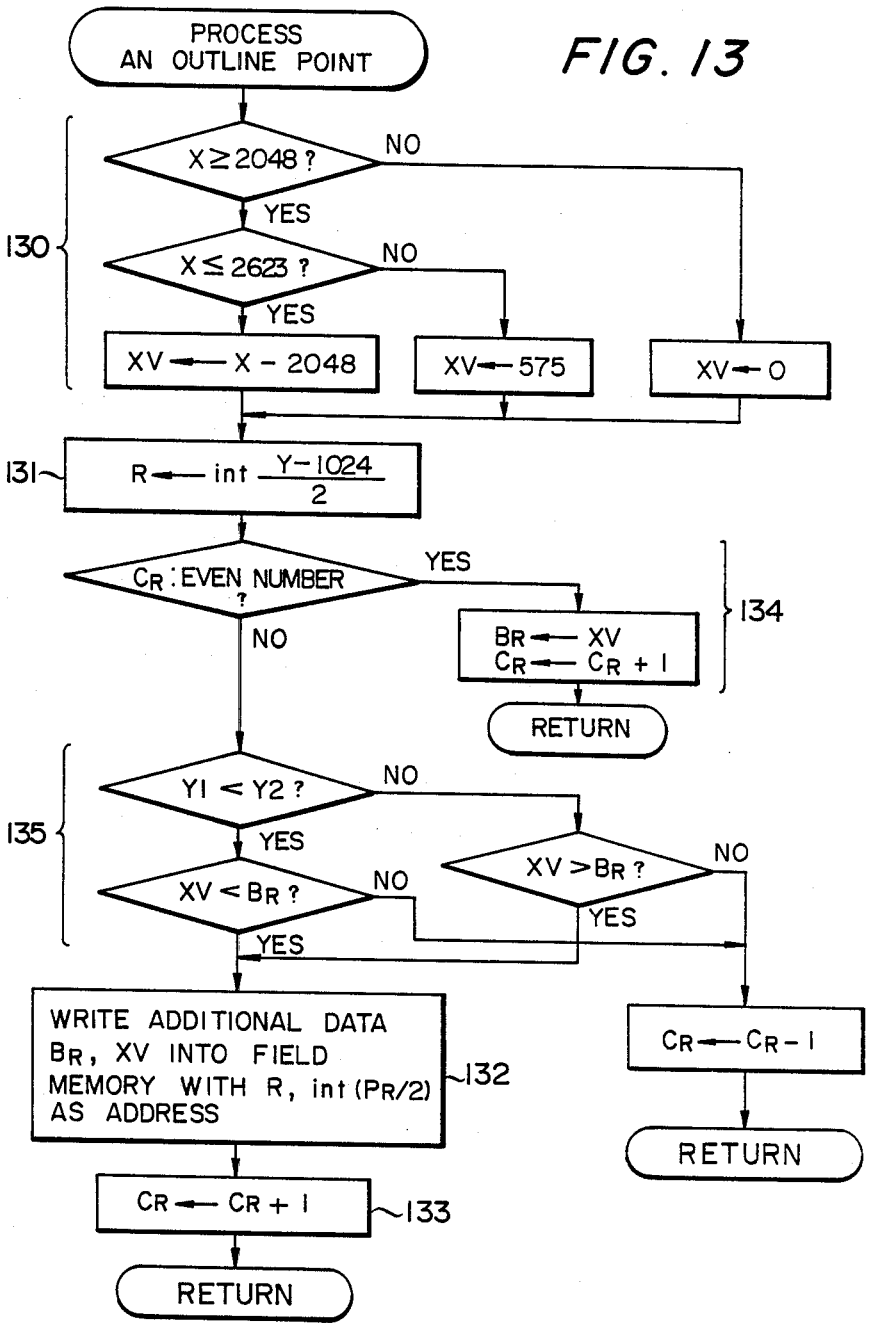

FIG. 13 shows the processing operation (Step 125) of an outline point shown in FIGS. 12A and 12B.

The field processor circuit in this embodiment first obtains a new coordinate XV with the left upper corner of the CRT display as the origin (Step 130). The new coordinate XV has a value equivalent to the value obtained by subtracting 2048 from the intrinsic X coordinate.

If the intrinsic X coordinate is out of the display, it is displayed on both ends of the display by setting the coordinates at XV=0 and XV=575, respectively (third stage of clipping).

The thus-newly-obtained XV coordinate functions as the X coordinate of an outline point computed by the field processor circuit 12 in this embodiment.

When the outline point is obtained in this manner, an address R for writing the outline point is next computed (Step 131). The function int (X) represents the maximum integer which does not exceed X, and (y−1024) represents a new Y coordinate with the left upper corner of the display as the origin.

The outline point XV is stored in the horizontal scanning memory area in the field memory 42 according to the address R, and the count value CR of the counter 60 which is provided in accordance with the corresponding area is increased by one (Steps 132, 133).

If the count value CR of the counter 60 is an even number, it shows that only the left outline point has been obtained. In this case, the outline point obtained is temporarily stored in the buffer 58 until the corresponding right outline point is obtained, and the count value CR of the counter 60 is increased by one (Step 134).

The image synthesizer of this embodiment displays a three-dimensional solid image on a two-dimensional plane as a pseudo-three-dimensional image.

The polygon information on the surface of a solid which is output from the image information supply source 10 is provided with the vertex coordinates supplied counterclockwise. On the other hand, information on the polygon situated on the reverse side of the solid is output as information on a polygon of reverse configuration provided with vertex coordinates supplied counterclockwise.

Accordingly, the field processor circuit in this embodiment compares the increase in the Y coordinate in combination with the values of the outline points and removes the information on the polygon of reverse configuration (Step 135).

In the field processor in this embodiment, the preprocessor circuit 46 and the division circuit 54 are in charge of the operations shown in FIGS. 9 to 11 and the former part of the operations shown in FIGS. 12A and 12B, and the segment circuit 56, the outline point buffer 58 and the outline point 60 are in charge of the latter part of the operations shown in FIGS. 12A and 12B and almost the entire part of the operations shown in FIG. 13.

Although in these flow charts the illustrated processings are serial for the purpose of simplifying the explanation, it is possible to introduce parallel processing, pipeline processing and the like, if necessary, in order to speed up the processings.

(e) Field memory

The memory circuit 32 in this embodiments consists of the field memory 42 without the additional memory 44. This is because the additional data to be dealt with is only a color code which has a comparatively small number of bits, as described above.

The field memory 42 stores outline information on all the polygons to be displayed in one field, and in this embodiment it is composed of an RAM of 28 bits$\times 2^{15}$ (32 K) words.

This field memory 42 has a capacity two times that of the actual working area of the dual port RAM, as described above. That is, one working area has a capacity of half the total capacity, namely, 28 bits$\times 2^{14}$ (16 K) words.

In this embodiment, the CRT alternately displays the field of an even number and the field of an odd number by skip scanning. Therefore, the memory space of the field memory 42 is divided into blocks which has one-to-one correspondence with each scanning line (Y=0, 2, 4, . . . ) of the field of an even number or each scanning line (Y=1, 3, 5, . . . ) of the field of an odd number, as shown in FIG. 4(B).

As explained under the title of C1: (a) specification, since the number of Y coordinates which constitute one frame is 448, the number of scanning lines in the field of an even number or the field of an odd number is 224. The maximum number of polygons which can be displayed on one horizontal scanning line is 64.

If one piece of outline point information (consisting of a pair of outline points and a color code) is stored in one word, the working area actually used in the field memory 42 in this embodiment has 28 bits$\times$14336 (=64$\times$224) words.

Figure 14:
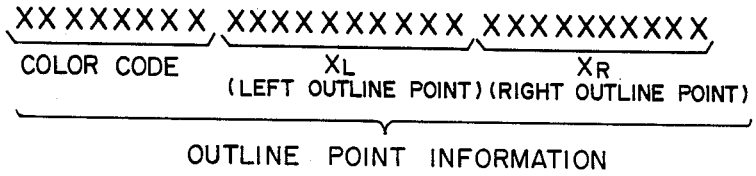
FIG. 14 is an explanatory view of outline point information used in an embodiment.

FIG. 14 shows the format of the outline point information which is to be written in the field memory 42. Each outline point information consists of a color code of 8 bits, the X coordinate XL of the left outline point of 10 bits and the X coordinate XR of the right outline point of 10 bits, namely, 28 bits of data in total.

Each piece of outline point information successively output from the field processor circuit 12 is written in the horizontal scanning memory area designated by the Y coordinate which is contained in the outline point information in the order of their addresses low number first and in the order of priority, and at the end of the memory area an end code is written.

If the horizontal scanning memory area is filled with 64 pieces of outline point information, the end code is not written.

Figure 15:
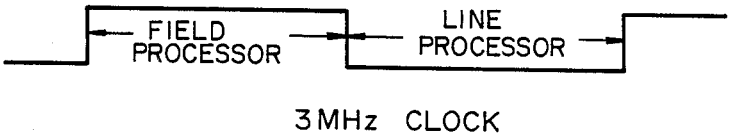
FIG. 15 is an explanatory view of the timing of readout/write for the field memory.

The field memory 42 in this embodiment is controlled by a 3 MHz clock in readout and writing operations, as shown in FIG. 15. That is, when the clock of the data output from the field processor is at an H level, information is written, while when the clock is at an L level, information is read out.

The field memory may be so constituted as to store half or a part of a frame in place of the entire part of one frame.

(f) Line buffer

FIGS. 5(A) and 6(A) show the format of the line buffer 36. The line buffer 36 has 0 to 575 addresses in correspondence to the respective pixels which constitute one scanning line. A memory area of 8 bits for storing the additional data is allotted to each address.

In this embodiment, the line buffer 36 is composed of a dual port RAM having two memory areas of 8 bits×576 words.

Every time outline point information is read from the field memory 42, the memory area defined by the left outline point XL and the right outline point XR is colored according to the additional data.

In the image synthesizer in this embodiment, the coloring out processing is only executed with respect to the vacant area of the line buffer 36, as will be described later.

(g) Line processor circuit

Figures 16, 16A:
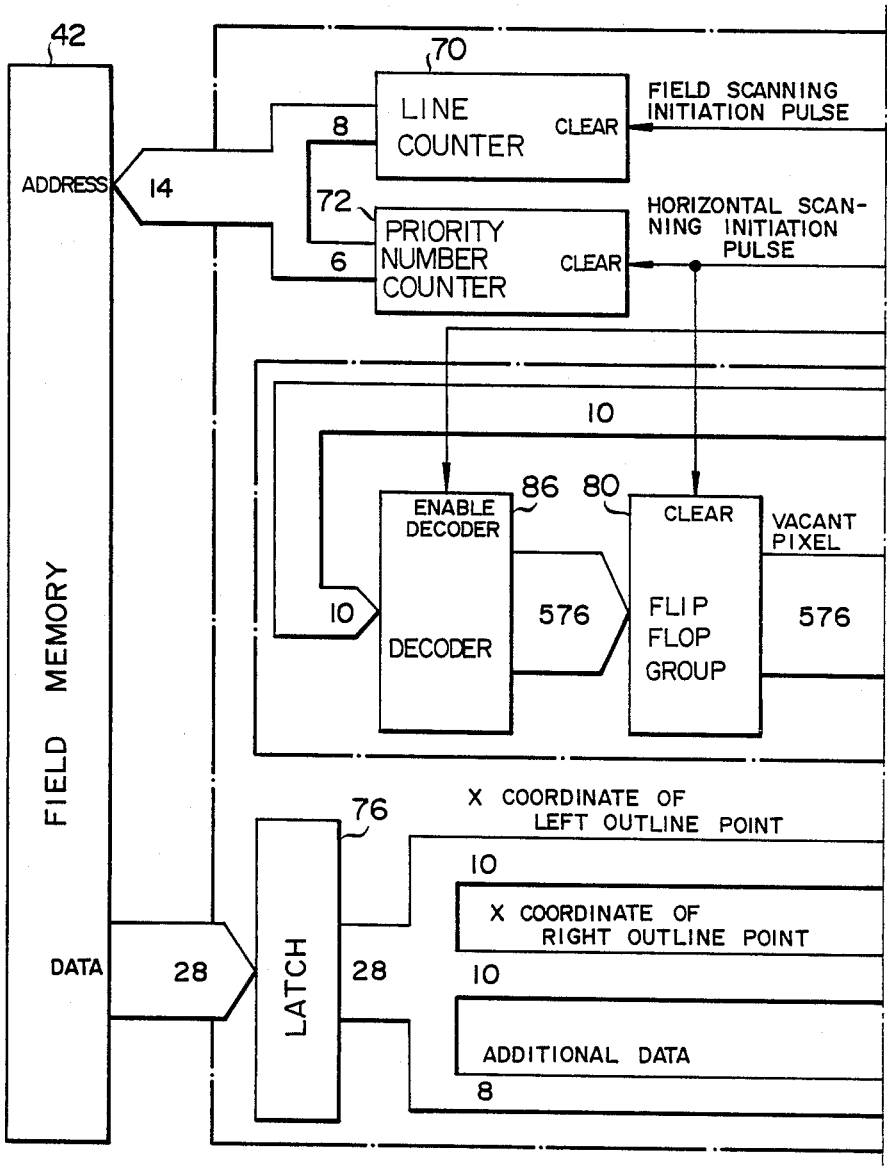
FIGS. 16, 16A and 16B are block diagrams of an example of a line processor circuit shown in FIG. 1.
Figure 16B:
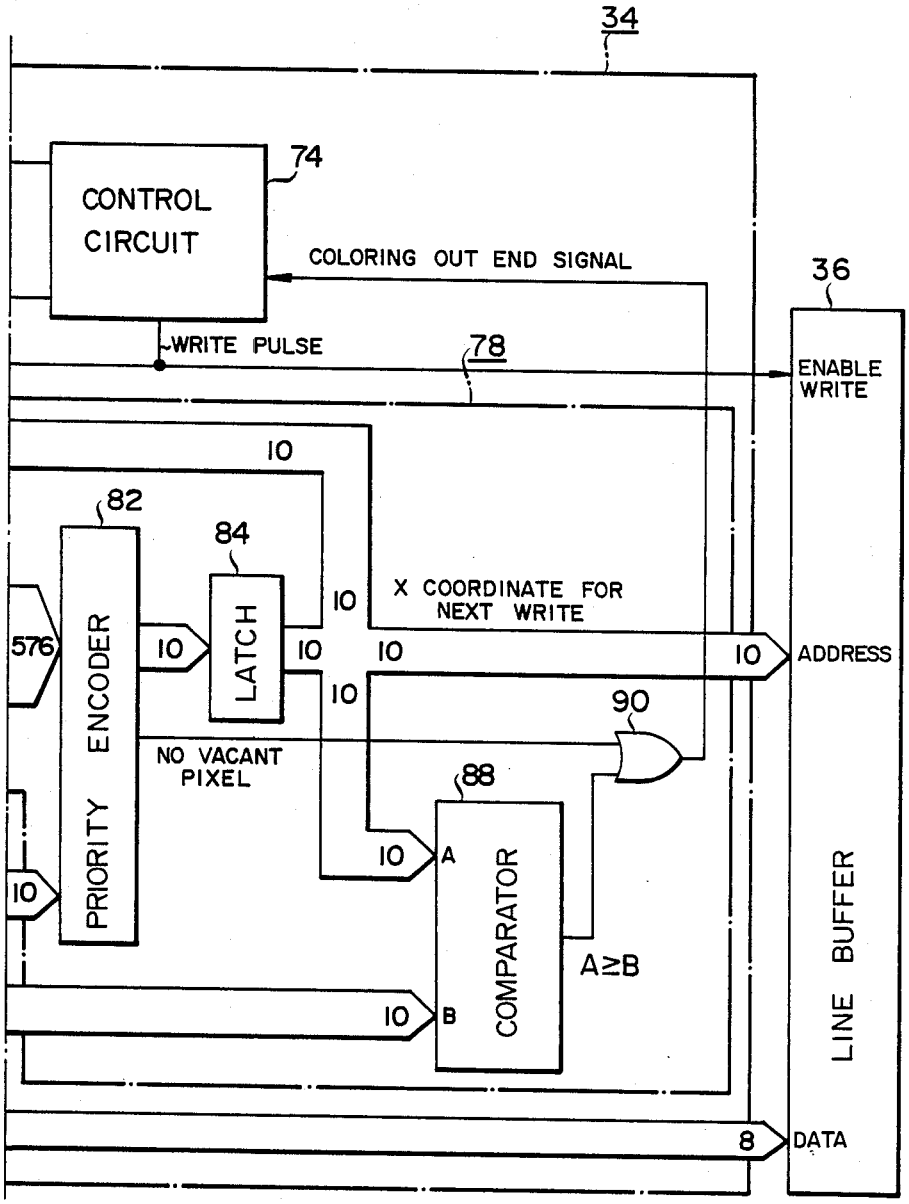

FIGS. 16A and 16B show the detailed structure of the line processor circuit 34.

The line processor circuit 34 in this embodiment reads outline point information on polygons from a predetermined horizontal scanning memory area in the field memory 42 in synchronization with the horizontal scanning of the CRT, and synthesizes and outputs an image signal for horizontal scanning through the line buffer 36.

* Readout of outline point information

The line processor circuit 34 in this embodiment includes a line counter 70 for outputting a selection signal of the corresponding scanning line in synchronization with the horizontal scanning of the CRT and a priority number counter 74 for successively producing priority numbers starting from 0. The outputs of these counters are outputted to the field memory 42 as a readout address.

The outputs of the line counter 70 and the priority number counter 72 are cleared every time a field scanning initiation pulse and a horizontal scanning initiation pulse are output from a control circuit 74.

As a result, outline point information is successively read in the order of priority from the horizontal scanning memory area designated by the selection signal (Y-coordinate data) which is output from the line counter 72.

At this time, the position XL of the left outline point and the position XR of the right outline point and the color code which are contained in each piece of outline point information are temporarily latched in a latch circuit 76.

* Coloring out Processing

The memory area in the line buffer 36 defined by the position of XL of the left outline point and the position XR of the right outline point is colored with the additional data every time outline point information is latched in the latch circuit 76.

The line processor circuit in this embodiment reads out outline point information on a new polygon every time the coloring out processing is completed, and a similar coloring out processing is carried out in the line buffer 36.

Therefore, for example, when outline point information is successively read from the horizontal scanning memory area of Y=20, the line buffer 36 is successively colored out with the additional data on the polygons A, B and C.

Since the line buffer 36 is colored out in the order in which the outline point information is read out, the additional data having higher priority is written on the line buffer 36 prior to the additional data having lower priority.

Therefore, it is necessary to write additional data to be written later only in vacant pixels in the line buffer 36 in order to prevent it from being written over the additional data previously written.

However, if vacant pixels in the line buffer 36 are detected by using what is called a read-modify-write technique, it is impossible to speed up the operation of the entire circuit.

One of the features of the present invention is that the line buffer 36 is colored out with the additional data without the need for a read-modify-write processing.

For this purpose, the line processor circuit in this embodiment is provided with a vacant area detection/-data write circuit 78 in order to detect vacant pixels in the line buffer 36 at the real time. Whenever outline point information is latched in the latch circuit 76, the additional data is written in the vacant pixels in the line buffer defined by the pair of outline points.

The circuit 78 in this embodiment includes a flip flop group 80, a priority encoder 82, a latch circuit 84, a decoder 86, a comparator 88 and an OR gate 90.

The flip flop group 80 consists of 576 flip flops which have one-to-one correspondence with all the pixels on one horizontal scanning line.

FIGS. 5(B) and 6(B) show the format of the flip flop group 80. The addresses of 0 to 575 are allocated to the 576 flip flops in correspondence with all the pixels which constitute one scanning line.

Each flip flop is set at "0" when the corresponding pixel is vacant, while it is set at "1" when the corresponding pixel has been colored out. The output of each flip flop is output to the priority encoder 82.

The priority encoder 82 compares the 576 pieces of vacant pixel information which are output from the flip flop group 80 in this way with the X coordinate (XL) of the left outline point of the polygon.

The pixel having an X coordinate value larger than the X coordinate (XL) of the left outline point and smaller than any other vacant pixel is selected, and the result of detection is output as "the X coordinate of the pixel for next write". The X coordinate of the pixel is output as the "write address" to the line buffer 36 through the latch circuit 84.

Consequently, the additional data on the polygon which is latched in the latch circuit 76 is written into the vacant pixel of the line buffer 36 which is designated by the write address.

At the same time, the output of the priority encoder 82 is fed back to the decoder 86 through the latch circuit 84. The flip flop designated by the X coordinate value is then set at "1" indicating the colored out state from "0" indicating a vacant pixel.

In this manner, the line processor circuit in this embodiment interlocks the line buffer 36 and the flip flop group 80, and as a result the vacant pixel between the left outline point XL and the right outline point XR in the line buffer 36 is colored out with new additional data.

The coloring out operation with respect to the area defined by one pair of outline points (XL and XR) is finished in the following cases.

(1) When there is no "vacant pixel" on the righthand side of the left outline point, the coloring out operation is finished.

In this case, a signal of an H level indicating that "there is no vacant pixel" is output from the priority encoder 82 to the OR gate 90.

(2) When the vacant pixel detected is equal to the right outline point or is situated on the righthand side thereof, the coloring out operation is finished. Such detection is executed in this embodiment by the comparator 88.

The comparator 88 compares the X coordinate of the right outline point output from the latch circuit 76 with the "X coordinate of the pixel for next write" output from the latch circuit 84, and when the X coordinate output from the latch circuit 84 equals or exceeds the X coordinate output from the latch circuit 76, a signal of an H level indicating the end of the coloring out operation is output to the OR gate 90.

The OR gate 90 outputs the thus-output signal of an H level to the control circuit 74 as the coloring out end signal. The control circuit 74 thereby increases the output of the priority number counter 72. The line processor circuit in this embodiment increases the output of the priority number counter 72 every time the coloring out operation based on the outline point information on one polygon is finished. Then, the next outline point information is read out and similar coloring operation is started.

* Example of coloring out operation

For example, when the outline point information on the polygons A, B and C is successively read in that order from the horizontal scanning memory area in the field memory designated by the address Y=20, the coloring out processing based on the thus-read-out outline point information is executed in the following way.

Before reading of the outline point information from the horizontal scanning memory area starts, all the pixels in the line buffer 36 are vacant. Therefore, in this state, all the flip flops in the flip flop group 80 are set at "0".

In this state, when the outline point information on the polygon A having the highest priority is first read out and latched in the latch circuit 76, the additional data thereof, namely, the red color code is successively written in the memory area in the line buffer defined by the pair of outline points XLA and XRA (the X area satisfying the condition $XLA \leqq X \leqq XRA$), as shown in FIG. 6(A).

Simultaneously, each flip flop in the flip flop group 80 defined by the pair of outline points XLA and XRA is set at "1", as shown in FIG. 6(B).

When the coloring out processing of the polygon A is finished, a coloring out end signal is output from the Or gate 90, and the priority number counter 72 is subjected to increment, thereby reading out the outline point information of the polygon B.

When the outline point information of the polygon B is read out, it is similarly latched in the latch circuit 76.

In this state, the flip flop group 80 detects that the area in the line buffer 30 defined by XLA and XRA has been colored, as shown in FIG. 6(B).

Therefore, the line processor 34 in this embodiment successively writs the additional data, namely, the blue color code in the vacant area ($XLB \leqq X < XLA$) in the line buffer 36 defined by the pair of outline points XLB and XRB.

Simultaneously, the line processor circuit in this embodiment successively sets the flip flops in the flip flop group 80 in the area defined by XLB and XLA at "1".

As a result, when the coloring out processing of the polygon B is finished, the color codes of the polygons A and B have been written in the line buffer 36, as shown in FIG. 5(A), and the flip flop group 80 detects the colored out area in the line buffer 36, as shown in FIG. 5(B).

At the same time with this, a coloring out end signal is input to the control circuit 74, and the outline point information on the polygon C is read out and the coloring out operation is carried out in the same way.

At this time, since there is no vacant area in the area defined by the pairs of XLC and XRC of the polygon C, the additional data is not written.

In this manner, the line processor circuit 34 in this embodiment is capable of synthesizing and writing an image signal for horizontal scanning with efficiency in the line buffer 36 at each horizontal scanning in synchronization with the horizontal scanning of the CRT.

The line processor circuit 34 in this embodiment successively outputs the color codes written in the line buffer 36 in this way to the color pallet memory 38 in synchronization with the horizontal scanning of the CRT in the order of "0", "1", . . . "575". Then, an image signal representing the polygons A and B with the designated colors is output to the CRT 40.

Accordingly, repetition of such operation synchronized with the horizontal scanning enables a desired image signal to be displayed on the CRT 40 at the real time on the basis of the polygon information output from the image information supply source 10.

* Processing of vacant pixels

As described above, there is a case in which vacant pixels (vacant memory area) remain in the line buffer 36 when all the coloring processings are completed with respect to one horizontal scanning line.

These vacant pixels are points situated outside all the polygons on the display, so that information indicating that there is no polygon on such vacant pixels must be output to the color pallet memory 38.

The following three methods may be considered as methods of achieving this.

(1) The line buffer 36 is initialized prior to the writing of data.

(2) All contents of the flip flop group 80 are serially output in synchronization with the output of an image signal.

(3) When all the coloring out processing of one horizontal line is completed, the vacant pixels of the line buffer 36 are colored out with vacant pixel information.

Among these, the method (3) is comparatively easy to adopt.

* Number of polygons displayable

Investigation has been made as to how many polygons can be displayed on one scanning line by using the line processor 34 in this embodiment.

As a result, it has been confirmed that it is possible on calculation to display more than 203 polygons per horizontal scanning line at the real time if the writing in the line buffer 36 is carried out at a cycle of 12 MHz dot clock.

* Dual port RAM

The line buffer 36 in this embodiment is composed of a dual port RAM, as described above, and is equally divided into two memory areas.

Accordingly, in the line buffer 36, while data is written in one memory area from the line processor circuit 36, the data which has been written is read from the other memory area, and while data are read from one memory area, data is written in the other memory area by the line processor circuit 34.

C2: Second Embodiment

—Other examples of the field memory 42—

In the present invention, the field memory 42 is provided with a plurality of horizontal scanning areas which correspond to the respective horizontal scanning lines.

It is possible to set such horizontal scanning areas by simply dividing the memory area in the field memory 42 into blocks corresponding in number to the total number of scanning lines, as shown in FIG. 4(B).

In this case, however, the memory capacity of each block is fixed and the number of polygons which can be displayed on one horizontal scanning line is restricted by the memory capacity of each block. As a result, a state frequently occurs in which although one block is overflowing, other blocks have many vacant areas, and this leads to lowered utilization efficiency.

To solve such problems, it is preferable to compose each horizontal scanning memory area as one of a completely discontinuous type or one of a semi-discontinuous type, thereby enabling the memory capacity to be set flexibly.

Completely discontinuous type

Figure 17:
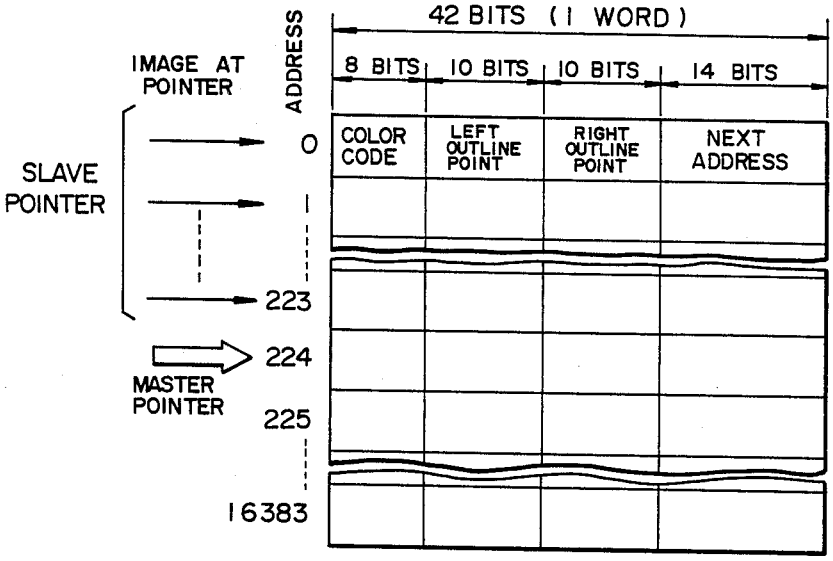
FIG. 17 is an explanatory view of another example of a field memory shown in FIG. 1.

FIG. 17 shows an example of such a completely discontinuous type field memory 42. In FIG. 17, the field memory 42 has a memory capacity of 16384 ($=2^{14}$) words per frame and 224 scanning lines/field except blanking.

Each word of the field memory 42 includes an item indicating the "next address", thereby enabling the line processor circuit 34 in a later stage to continuously read the outline point information for one scanning line.

The field memory 42 in this example has 16384 ($=2^{14}$) words per frame, so that an address of 14 bits is necessary for addressing the next readout.

Therefore 8 bits, 10 bits, 10 bits and 14 bits are allotted to the additional data, the left outline point, the right outline point and the next address, respectively, in the memory space, so that a memory space of 42 bits per word is required.

In order to write data in the field memory 42 of this type, it is necessary to provide 224 slave pointers which have one-to-one correspondence with the horizontal scanning lines of the CRT and one master pointer in the field processor circuit 12.

Each slave pointer is used for addressing the outline point information to be written next in the same horizontal scanning memory area.

The master pointer is used to set the address of the word designated by a slave pointer, the address being written in the item of "next address".

The address output from the master pointer is so controlled as to be the address which has not been designated by the slave pointer and which has the smallest number in an area where no data has yet been written.

The operation of writing outline point information by using the slave pointers and the master pointer will next be explained.

The slave pointers and the master pointer are initialized prior to data writing. The slave pointers designate the head addresses 0, 1, 2, . . . 223 of the corresponding horizontal scanning memory areas. The master pointer designates the address 224.

When the field processor circuit 12 starts to compute and output outline point information, the computed outline point information is written in the horizontal scanning memory area designated by the Y coordinate in the following process.

When the field processor circuit 12 computes the first outline point information on the scanning line, the slave pointer which corresponds to the Y coordinate of this outline point information addresses the writing of field memory 42.

The computed outline point information is written in the items of "additional data", "left outline point" and "right outline point", and in the item of "next address" the address "224" which is being pointed by the master point is written.

The slave pointer is changed so as to point at the address "224" of the master address, which is the same address written in the item of "next address", and simultaneously the address output by the master pointer is increased to "225".

As a result, when the next outline point information on the same line is next computed, the slave pointer writes the outline point information in each item of "additional data", "left outline point" and "right outline point" of the word which is designated by the address 224, and writes the address which is being pointed at by the master pointer at that time into the item of "next address".

When the write operation is finished, the slave pointer newly points at the address of the master pointer written in the item of "next address", and simultaneously the address output by the master address is increased by one.

When the field memory 42 in this example finishes writing the outline point information on all polygons, it writes the end code at the address indicated by each slave pointer.

According to the above-described structure, each horizontal scanning memory area is treated as a series of memory areas connected by the address written in the item of "next address" of each word.

For example, if the line processor circuit 34 reads outline point information from the horizontal scanning memory area which corresponds to the scanning line m, the outline point information written in the horizontal scanning memory area is read out one item after another with the address m as the starting point and with reference to the "next address" until the end code is read out.

Figures 18, 18A:
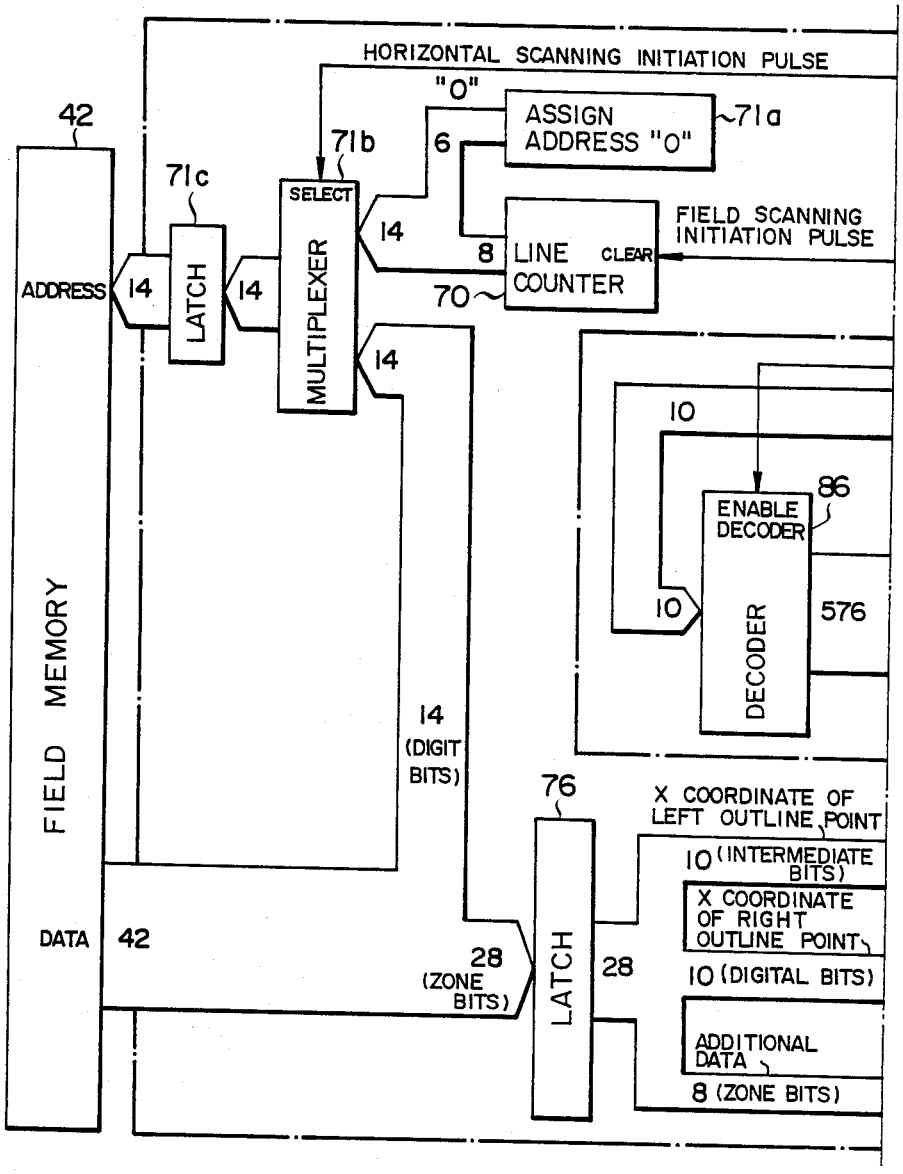
FIGS. 18, 18A and 18B are explanatory views of a line processor circuit used for the field memory shown in FIG. 17.
Figure 18B:
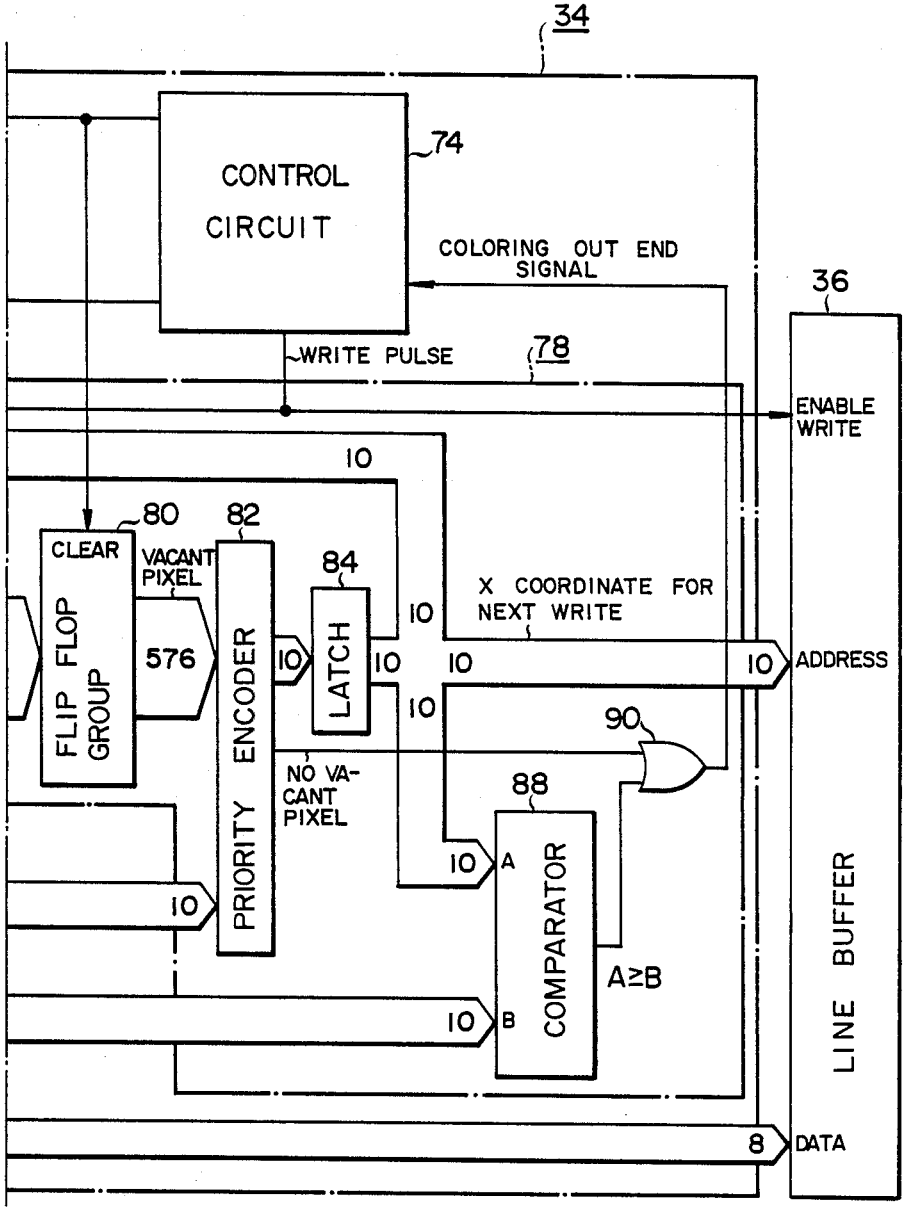

FIGS. 18A and 18B show an example of the data read unit of the line processor circuit 34 which is used for the field memory 42 having the above-described structure.

In FIGS. 18A and 18B, the same numerals are provided for the elements corresponding to those in the first embodiment, and explanation thereof will be omitted.

In this embodiment, the line processor circuit 34 includes a line counter 70 for outputting the selection signal (Y-coordinate data) of the corresponding scanning line in synchronization with the horizontal scanning of the CRT and an address "0" assignment circuit 71*a* for outputting 6-bit information for assigning the address 0 of the corresponding scanning line. The outputs of the line counters 70 and the address "0" assignment circuit are output as the address for reading out the head word to the field memory 42 through a multiplexer 71*b* and a latch circuit 71*c*.

Then, readout of the outline point information is started from the head word in the horizontal scanning memory area designated by the selection signal (Y-coordinate data).

The line processor circuit 34 in this embodiment simultaneously outputs the address of 14 bits written in the item of "next address" of this read-out word, and inputs the address into the multiplexer 71*b*.

The multiplexer 71*b* automatically selects the next address which is read from the field memory 42 and outputs it to the latch circuit 71*c*.

Therefore, for example, when the selection signal of the scanning line m is output from the line counter 70 of the line processor circuit 34, the outline point information is read out of the horizontal scanning memory area m one item after another with the address m as the starting point and with reference to the "next address" until the end code is detected.

Semi-discontinuous type

If the horizontal scanning memory area is so designed as to have a completely flexible memory capacity, as shown in FIG. 17, it is necessary to allocate 14 bits to the item of "next address", thereby disadvantageously increasing the number of bits required to constitute one word from 28 to 42 and the total capacity of the field memory 42 by about 1.5 times.

To solve such problems, it is preferable to make the horizontal scanning memory area one of a semi-discontinuous type.

Figure 19:
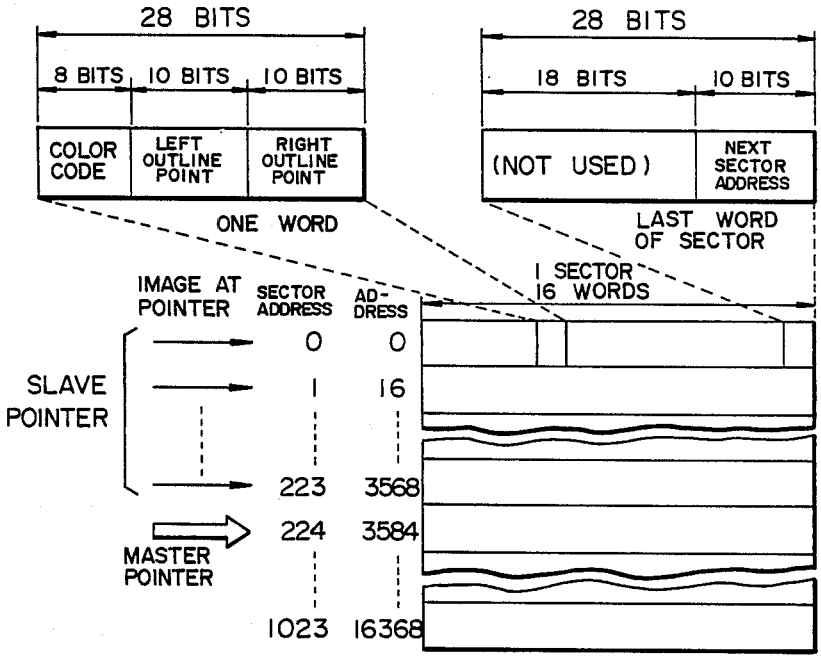
FIG. 19 is an explanatory view of still another example of a field memory shown in FIG. 1.
Figure 21:
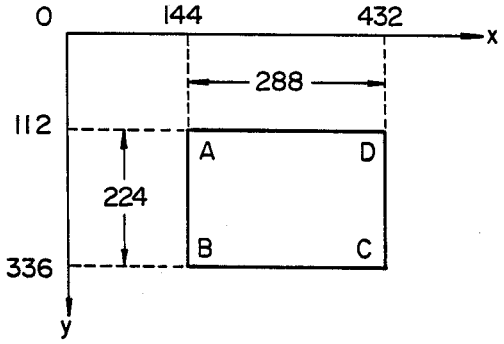
FIG. 21 is an explanatory view of a displayed image used for comparison of data between the image synthesizer according to the present invention and a conventional

FIG. 19 shows an example of such field memories.

The memory space of the field memory 42 of this example is equally divided into sector blocks constituted by a plurality of words.

The number of blocks must be at least larger than the number of all the scanning lines, and in this example, the memory space is divided into 1024 sector blocks.

The last word of each sector block is allocated to the "next sector address".

In FIG. 19, the sector address is an address for designating each sector block, and is represented by the number obtained by dividing the head address of each sector block by the number of words in the sector block.

In this example, the capacity of the field memory for one frame is set at 16384 ($=2^{14}$) words, and the number of words per sector block is set at 16 ($=2^4$). Therefore, the number of the sector blocks for one frame is 1024 ($=2^{10}$), and the sector address is represented in the range of 0 to 1023.

The operation of writing outline point information in the thus-formed field memory 42 will now be explained.

For such writing operation, it is necessary to prepare 224 slave pointers which correspond to the number of the scanning lines and one master pointer.

In this example, there are a plurality of words in each sector block. Therefore, it is to be noted that the slave pointer provided in correspondence with each scanning line points at the address assigned to each word, while the master pointer points at the sector address assigned to each sector block.

When the field processor circuit 12 starts to compute the outline point information, the slave pointers and the master pointer are initialized.

As a result, each slave pointer points at the head address 0, 16, 32, . . . 3568 of the sector blocks 0, 1, 2, . . . 223, respectively, and the master pointer points at the sector address 224.

When the outline point information starts to be output, each piece of outline point information is successively written in the vacant word designated by the slav pointer which corresponds to the Y coordinate. The slave pointer designates the next vacant word every time the writing of the outline point information is completed.

In this way, the process for writing the outline point information in each sector block is carried out in the same way as shown in FIG. 4(B).

When the slave pointer points at the last word of a certain sector block and the outline point information to be written therein is output, the following processing is carried out.

The value output by the master pointer, for example, 224 is first written as the "next sector address" in the address pointed at by the slave pointer.

The head address of the sector block pointed at by the master pointer is set at the slave pointer, and simultaneously the sector address output by the master pointer is increased by one.

Thereafter, the outline point information is successively written in the addresses newly pointed at by the slave pointer, accompanied by an increment of the address of the slave pointer each time.

The field memory 42 in this example having the above-described structure is capable of greatly reducing the bit numbers required per word in comparison with the field memory 42 shown in FIG. 17.

Figures 20, 20A:
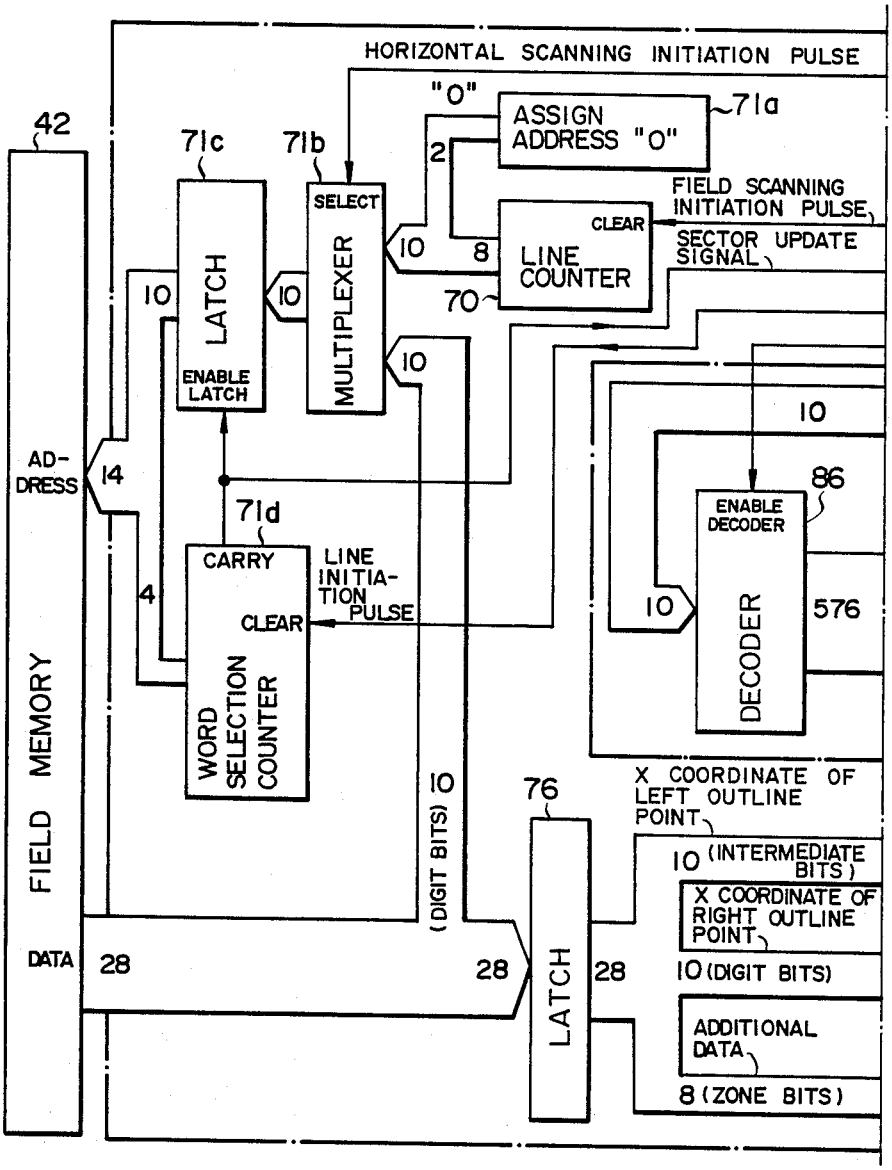
FIGS. 20, 20A and 20B are explanatory views of a line processor circuit used for the field memory shown in FIG. 19.
Figure 20B:
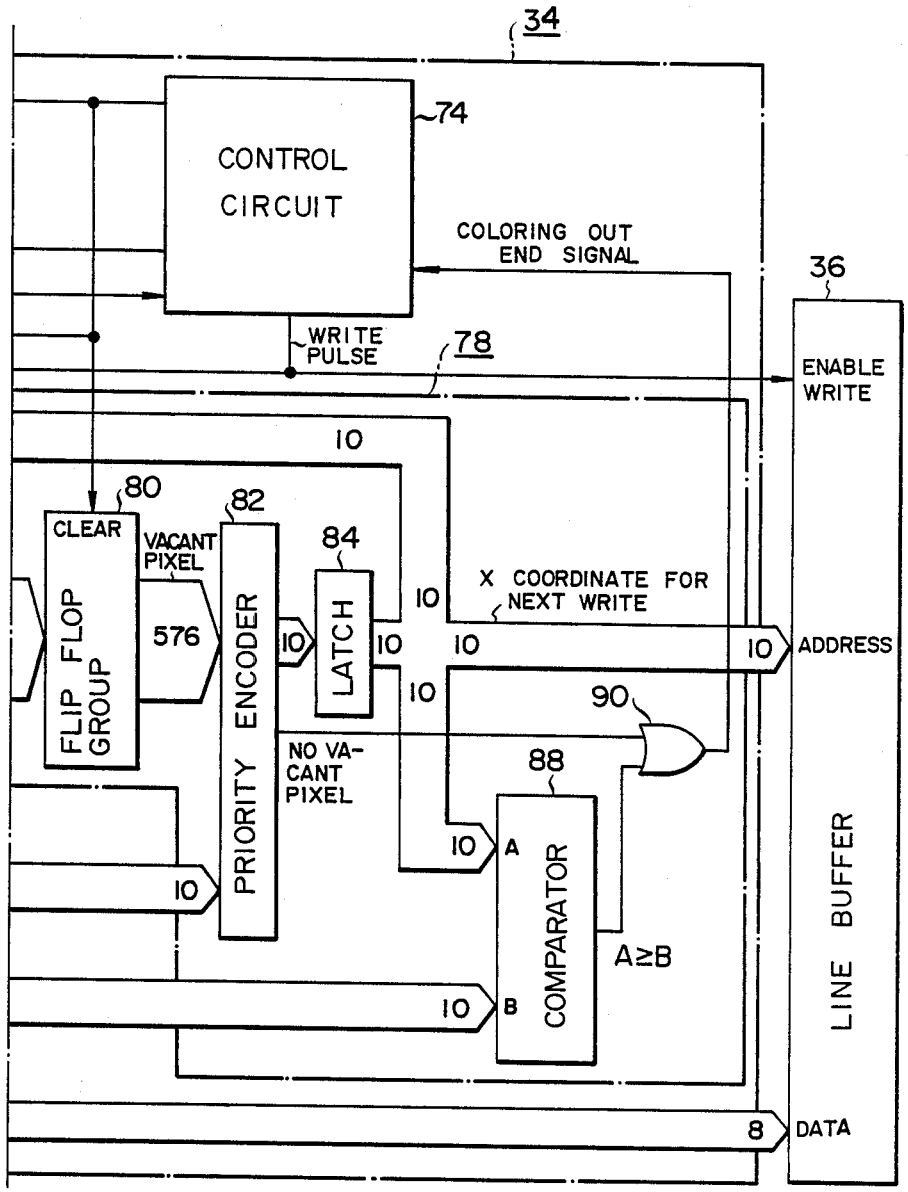

FIGS. 20A and 20B show an example of data read units of the line processor circuit 34 used for the semi-discontinuous field memory 42 of this type.

The line processor circuit 34 includes the line counter 70, the address "0" assignment circuit 71*a*, the multiplexer 71*b*, the latch circuit 71*c* and a word selection counter 71*d*.

The semi-discontinuous type field memory 42 has sector addresses 0 to 1023, and each of these sector addresses is assigned by the 10 zone bits of the readout address which is output by the latch circuit 71.

In this example, the head sector address of the horizontal scanning emory area of the scanning line is output from the line counter 70 and the address "0" assignment circuit 71*a* in synchronization with the horizontal scanning of the CRT.

Word assignment signals for designating the readout word in the designated sector are successively output from the word selection counter 71*d*.

In this example, one sector consists of 16 words. Therefore, the word selection counter 71*d* repeatedly outputs 16 word assignment addresses with respect to the corresponding words from 0 to 15.

The word selection counter 71*d* is set at "0" at the start of horizontal scanning. The latch circuit 71*c* outputs a sector address and updates the memory contents only when the word selection counter 71*d* indicates "0". The multiplexer 71*b* selects the output of the line counter 70 and "0" of 2 bits of the address "0" assignment circuit 71*a* only at the start of horizontal scanning.

The line counter 70 indicates "0" at the start of field scanning.

It is assumed that the line counter 70 outputs the selection signal m of the horizontal scanning memory area which corresponds to the scanning line m at the initiation of horizontal scanning.

The output m of the line counter with "0" of 2 bits added thereto is read by the latch circuit 71*c* through the multiplexer 71*b* and is output as the sector address.

At the same time as this, the word selection counter 1*d* in the sector is cleared to "0". As a result, the address 16 m of 16 bits is input to the field memory 42.

This is the head address of the horizontal scanning memory area which corresponds to the scanning line m, and the first piece of outline point information is read from the field memory 42.

In this way, whenever the processing of the outline point information is completed, the word selection counter 71*d* counts 1, 2, . . . 14, while the sector address output from the latch circuit is held as it is, and the second, third, . . . 15th piece of outline information is read out.

When the word selection counter 71*d* outputs the value 15, the "next sector address" is read from the field memory 42 in place of outline point information, and is input to the latch circuit 71*c* through the multiplexer 71*b*.

When the word selection counter 71*d* continues to count, it outputs the value "0" again, whereby the latch circuit 71*c* outputs the next sector address.

In this manner, the outline point information is continuously read out in the sector, and when readout is finished in one sector, outline point information is read out one item after another with reference to the "next sector address".

The readout operation of outline point information is continued until the end code is detected.

As explained above, according to the present invention, since it is capable of coloring out the additional data in the line buffer in the order of priority without any read-modify-write operation, real-time synthesis of an image signal is enabled which involves no possibility of omission of a figure having a high priority without the need for enlarging the size of the entire apparatus.

While there has been described what are at present considered to be preferred embodiments of the invention, it will be understood that various modifications may be made thereto, and it is intended that the appended claims cover all such modifications as fall within the true spirit and scope of the invention.

What is claimed:

1. An image synthesizer comprising:

an outline point information storing means for successively writing and storing outline point information which consists of the positions of pairs of right and left outline points at which the outline of a figure for CRT display intersects respective horizontal scanning lines and additional data on said figure, in the order of priority of said outline point information, into respective horizontal scanning memory areas which are provided in correspondence with the respective horizontal scanning lines;

a line processor circuit for successively reading said outline point information out of said horizontal scanning memory means which correspond to respective vertical scanning positions in synchronization with respective horizontal scanning signals; and a line buffer having memory areas of a number which at least corresponds to the number of pixels for one horizontal scanning, and in which, into the memory areas which are defined by the corresponding pair of outline points, the additional data contained in the read out outline point information are written and stored in succession;

said liner processor circuit including:

a data read unit for successively reading said outline point information, in the order of priority, from said horizontal scanning memory areas which correspond to said respective vertical scanning positions, in synchronization with said respective horizontal scanning signals, a vacant area detecting unit for detecting, in real time, a vacant memory area in said line buffer, that is defined by the pairs of right and left outline points, every time the outline point information is read, and also for outputting the right and left outline points of the foregoing detected vacant memory area, as the writable pairs of right and left outline points, and a data write unit for writing said additional data into the vacant area that is located in said line buffer which is defined by the writable pairs of outline points every time the outline point information is read in the order of priority;

whereby an image signal for horizontal scanning is synthesized and outputted through said line buffer every time said horizontal scanning signal is outputted.

2. An image synthesize according to claim 1, wherein said outline point information storing means includes a field memory having a plurality of horizontal scanning memory areas which correspond to the respective horizontal scanning lines, and the outline point information which has been input is successively written and stored in the corresponding horizontal scanning memory area in accordance with the priority.

3. An image synthesizer according to claim 2, wherein said field memory and said line buffer are composed of a dual port RAM in which data write operation and data readout operation are executed independently of each other.

4. An image synthesizer according to claim 1, wherein said outline point information includes a field memory and an additional data memory, in the respective horizontal scanning memory areas of said field memory, the positions of said pairs of outline points and the identification numbers of figures are written and stored, and in said additional data memory, said additional data is written and stored with said identification numbers of said figures as the respective addresses.

5. An image synthesizer according to claim 1, wherein said image synthesizer is a pseudo-three-dimensional image synthesizer including:

an image information supply source which deals with three-dimensional solid information, converts the three-dimensional information to be displayed into combined information on two-dimensional figures by subjecting said three-dimensional solid information to a predetermined information processing, and outputs said combined information as pseudo-three dimensional information; and a field processor circuit which calculates the outline of each figure displayed on said CRT on the basis of said pseudo-three-dimensional information which is output from said image information supply source, and outputs the positions of pairs of right and left outline points at which the outline of a figure which has been calculated intersects respective horizontal scanning lines and additional data which corresponds to said pairs of outline points to said outline point information storing means as outline point information on each figure.

6. An image synthesizer according to claim 5, wherein said image information supply source converts each three-dimensional object into combined information of a plurality of two-dimensional polygons and outputs said combined information as said pseudo-three-dimensional information.

7. An image synthesizer according to claim 5, wherein a communication memory for successively outputting polygon information which is output from said image information supply source in the order of priority to said field processor circuit is provided between said image information supply source and said field processor circuit.

8. An image synthesizer according to claim 1, wherein a color code indicating the color of a figure is written and stored in said outline point information storing means.

9. An image synthesizer according to claim 8, wherein said image signal synthesized in said line buffer for horizontal scanning is output to a color pallet memory in synchronization with a horizontal scanning of said CRT, and said color pallet memory converts said color code contained in said image signal into a color signal and outputs said color signal to said CRT.

10. An image synthesizer according to claim 1, wherein said data read unit of said line processor circuit includes a line counter for outputting a selection signal of the corresponding scanning line in synchronization with a horizontal scanning of said CRT, and a priority number counter for producing priority numbers, and said data read unit outputs the output of each counter as the readout address to said outline point information storing means, and successively reads said outline point information from the horizontal scanning memory area which is designated by said line counter through a latch circuit in the order of priority.

11. An image synthesizer comprising:

an outline point information storing means for successively writing and storing outline point information which consists of the positions of pairs of right and left outline points at which the outline of a figure for CRT display intersects respective horizontal scanning lines and additional data on said figure in the order of priority in respective horizontal scanning memory areas which are provided in correspondence with the respective horizontal scanning lines;

a line processor circuit coupled to said outline point information storing means for successively reading said outline point information out of said outline point information storing means in synchronization with a horizontal scanning signal form the horizontal scanning memory area which corresponds to a vertical scanning position; and a line buffer having memory areas of a number which at least corresponds to the number of pixels for one horizontal scanning and being coupled to said outline point information storing means directly or indirectly, said line buffer for successively writing the additional data contained in the outline information which has been read from said horizontal scanning memory area into the memory areas which are defined by the corresponding pair of outline points;

said line processor circuit including:

a vacant area detection unit for detecting a vacant area in said line buffer at the real time during each horizontal scanning period, a data read unit for successively reading out said outline point information in the order of priority in synchronization with said horizontal scanning signal from said horizontal scanning memory area which corresponds to said vertical scanning position, and a data write unit for writing said additional data in the vacant area in said line buffer which is defined by the corresponding pair of outline points every time the outline point information is read;

whereby an image signal is synthesized and outputted through said line buffer every time said horizontal scanning signal is outputted; and wherein:

said line processor circuit is provided, as a vacant area detection unit and data write unit, with a vacant area detection/data write circuit for detecting vacant pixels in said line buffer at the real time and for writing said additional data in the vacant pixels in said line buffer defined by the pair of outline points which are read whenever outline point information is read from said horizontal scanning memory areas, said vacant area detection/data write circuit includes:

a flip-flop group for individually detecting whether the corresponding pixel is vacant or not, and outputting the vacant pixel information in said line buffer, and a priority encoder which compares the X coordinate of the left outline point with said vacant pixel information whenever said outline point information is read from said horizontal scanning memory areas, outputs the vacant pixel that has the smallest X coordinate value of the vacant pixels having X coordinate values larger than said X coordinate of said left outline point as a line buffer write address, and outputs said line buffer write address to said flip flop group which outputs new vacant pixel information, and said vacant area detection/data write circuit finishes writing said additional data which is read from said horizontal scanning memory areas in said line buffer when there is no vacant pixel on the right hand side of the X coordinate of said left outline point or when the vacant pixel detected is equal to the right outline point or is situated on the right hand side thereof, sand reads next outline point information from said horizontal scanning memory areas, thereby similarly writing said additional data into said line buffer.

12. An image synthesizer comprising:

an outline point information storing means for successively writing and storing outline point information which consists of the positions of pairs of right and left outline points at which the outline of a figure for CRT display intersects respective horizontal scanning lines and additional data on said figure in the order of priority in respective horizontal scanning memory areas which are provided in correspondence with the respective horizontal scanning lines;

a line processor circuit coupled to said outline point information storing means for successively reading said outline point information out of said outline point information storing means in synchronization with a horizontal scanning signal from the horizontal scanning memory area which corresponds to a vertical scanning position; and a line buffer having memory areas of a number which at least corresponds to the number of pixels for one horizontal scanning and being coupled to said outline point information storing means directly or indirectly, said line buffer for successively writing the additional data contained in the outline information which has been read from said horizontal scanning memory area into the memory areas which are defined by the corresponding pair of outline points;

said line processor circuit including:

a vacant area detection unit for detecting a vacant area in said line buffer at the real time during each horizontal scanning period, a data read unit for successively reading out said outline point information in the order of priority in synchronization with said horizontal scanning signal from said horizontal scanning memory area which corresponds to said vertical scanning position, and a data write unit for writing said additional data in the vacant area in said line buffer which is defined by the corresponding pair of outline points every time the outline point information is read;

whereby an image signal is synthesized and outputted through said line buffer every time said horizontal scanning signal is outputted; and wherein:

said outline point information storing means includes a field memory having a plurality of horizontal scanning memory areas which correspond to the respective horizontal scanning lines, and the outline point information which has been inputted is successively written and stored in the corresponding horizontal scanning memory area in accordance with the priority;

said field memory is composed of a completely discontinuous type memory including:

a reference memory space which is provided with a plurality of reference words having one-to-one correspondence with each horizontal scanning line of said CRT, and a reserve memory space provided with a plurality of reserve words, each word of said memory spaces being composed of fields for additional data, left outline point, right outline point and next address, and said field memory is composed that a predetermined word which corresponds to a horizontal scanning line is first designated from the said reference memory space in synchronization with a horizontal scanning of said CRT, the additional data, the left outline point and the right outline point of the calculated outline point information are written into the respective fields of said word, the first vacant word in said reserve memory space being written into the field for next address as the write address for next outline point information, the additional data, the left outline point and the right outline point are written into the respective fields of the designated word in said reserve memory space, and the next vacant word in said reserve memory space is written in the field for next address as the write address for next outline point information, and when the calculation and writing of the outline point information on said horizontal scanning line is completed, an end code is immediately written into the field for next address of the corresponding word.

13. An image synthesizer comprising:

an outline point information storing means for successively writing and storing outline point information which consists of the positions of pairs of right and left outline points at which the outline of a figure for CRT display intersects respective horizontal scanning lines and additional data on said figure in the order of priority in respective horizontal scanning memory areas which are provided in correspondence with the respective horizontal scanning lines;

a line processor circuit coupled to said outline point information storing means for successively reading said outline point information out of said outline point information storing means in synchronization with a horizontal scanning signal from the horizontal scanning memory area which corresponds to a vertical scanning position; and a line buffer having memory areas of a number which at least corresponds to the number of pixels for one horizontal scanning and being coupled to said outline point information storing means directly or indirectly, said line buffer for successively writing the additional data contained in the outline information which has been read from said horizontal scanning memory area into the memory areas which are defined by the corresponding pair of outline points;

said line processor circuit including:

a vacant area detection unit for detecting a vacant area in said line buffer at the real time during each horizontal scanning period, a data read unit for successively reading out said outline point information in the order of priority in synchronization with horizontal scanning signal from said horizontal scanning memory area which corresponds to said vertical scanning position, and a data write unit for writing said additional data in the vacant area in said line buffer which is defined by the corresponding pair of outline points every time the outline point information is read;

whereby an image signal is synthesized and outputted through said line buffer every time said horizontal scanning signal is outputted; and wherein:

said outline point information storing means includes a field memory having a plurality of horizontal scanning memory areas which correspond to the respective horizontal scanning lines, and the outline point information which has been inputted is successively written and stored in the corresponding horizontal scanning memory area in accordance with the priority;

said field memory is composed of semi-discontinuous type memory including:

a reference memory space which is provided with a plurality of reference word strings having one-tone correspondence with each horizontal scanning line of said CRT, and a reserve memory space provided with a plurality of reserve word strings, each of said word strings including:

a plurality of write words which consist of write fields for additional data, left outline point and right outline point, respectively, and a final word consisting of a field for address into which a write end code or a vacant word string in said reserve memory space is written, and said field memory is so composed such that a predetermined word string which corresponds to a horizontal scanning line is designated from said reference memory space in synchronization with a horizontal scanning of said CRT, the additional data, the left outline point and the right outline point of the calculated outline point information are subsequently written into the respective write words of said word string, and when the number of items calculated outline point information is less than the number of said write words which are provided in the designated work string, an end code is written in said final word of said word string, while when the number of items calculated outline point information exceeds the number of said write words which are provided in the designated. word string, the first vacant word string in said reserve memory space is written in said final word as the write address for next outline point information, and the rest of said outline point information is written into each write word in said reserve memory.

* * * * *

UNITED STATES PATENT AND TRADEMARK OFFICE

CERTIFICATE OF CORRECTION

PATENT NO. : 4,829,295

DATED : May 9, 1989

INVENTOR(S) : Hiroyuki Murata

It is certified that error appears in the above-identified patent and that said Letters Patent is hereby corrected as shown below:

On the title page, under item [19], "Hiroyuki" should read --Murata-- and item [75] Inventor: Change "Murata Hiroyuki, Tokyo, Japan"

to --Hiroyuki Murata, Tokyo, Japan--

Signed and Sealed this

Fifteenth Day of May, 1990

*Attest:*

HARRY F. MANBECK, JR.

*Attesting Officer*

*Commissioner of Patents and Trademarks*